US006070045A

United States Patent [19]

Hara et al.

[11] Patent Number: 6,070,045

[45] Date of Patent: May 30, 2000

[54] LIQUID SPREADING DEVICE AND A FIXING DEVICE

[75] Inventors: Kazuyoshi Hara, Toyohashi; Sanji Inagaki; Kouji Matsushita, both of Toyokawa, all of Japan

[73] Assignee: Minolta Co., Ltd., Osaka, Japan

[21] Appl. No.: 09/245,760

[22] Filed: Feb. 8, 1999

[30] Foreign Application Priority Data

Feb. 9, 1998 [JP] Japan ..... 10-026973

[51] Int. Cl.[7] ..... G03G 15/20

[52] U.S. Cl. ..... 399/325; 118/261; 118/DIG. 1

[58] Field of Search ..... 399/324, 325, 399/237, 241, 248; 118/DIG. 1, 258, 261; 219/216

[56] References Cited

U.S. PATENT DOCUMENTS

| | | | |
|---|---|---|---|
| 4,488,504 | 12/1984 | Vineski . | |
| 5,212,527 | 5/1993 | Fromm et al. | 118/DIG. 1 X |
| 5,596,396 | 1/1997 | Landa et al. | 399/237 |
| 5,625,859 | 4/1997 | Moser | 399/325 |
| 5,697,036 | 12/1997 | Moser | 399/325 X |

FOREIGN PATENT DOCUMENTS 59-139074 8/1984 Japan .

*Primary Examiner*—Sophia S. Chen
*Attorney, Agent, or Firm*—McDermott, Will & Emery

[57] ABSTRACT

A liquid spreading device for spreading liquid over a target surface to be moved relatively to the liquid spreading device in a predetermined direction, including: a regulating member which is brought into contact with the target surface through the liquid; and a voltage applying unit for applying an electrical bias voltage across the regulating member and the target surface.

A fixing device for fixing a toner image onto an image bearing surface of a recording sheet, including: a rotating member having an outer surface to be in contact with the image bearing surface; a regulating member which is brought into contact with the outer surface of the rotating member through the liquid; and a voltage applying unit for applying an electrical bias voltage across the regulating member and the outer surface of the rotating member.

A fixing device including: a rotating member having an outer surface to be in contact with the image bearing surface; a spreading roller which is provided for spreading liquid over the outer surface of the rotating member and has an outer surface in contact with the outer surface of the rotating member; a regulating member which is brought into contact with the outer surface of the spreading roller through the liquid; and a voltage applying unit for applying an electrical bias voltage across the regulating member and the outer surface of the spreading roller.

67 Claims, 8 Drawing Sheets

LIQUID SPREADING DEVICE AND A FIXING DEVICE

This invention is based on patent application No. H10-26973 filed in Japan, the contents of which are hereby incorporated by reference.

BACKGROUND OF THE INVENTION

1. Field of the Invention

The present invention relates to a liquid spreading device for spreading liquid over a target surface of a predetermined member. Also, the invention relates to a fixing device for fixing an unfixed toner image, which is carried on a recording sheet, onto the recording sheet, and particularly a fixing device provided with a rotating member having an outer peripheral surface to which liquid such as oil is applied for increasing releasability from toner.

2. Description of the Background Art

In electrophotographic image forming apparatuses such as a copying machine and a printer, a toner image is transferred onto a recording sheet (e.g., paper sheet) by an electrophotographic image forming process.

The toner image transferred onto the recording sheet is merely carried on the recording sheet in an initial stage, and therefore the toner image will be usually fixed onto the recording sheet by a fixing device.

The fixing device generally has two fixing rollers opposed to each other. Usually, a heat source is provided for one of the fixing rollers for heating the roller. Usually, these two fixing rollers are pressed to each other.

When fixing the unfixed toner image onto the recording sheet, the recording sheet is moved between these fixing rollers for applying a heat and a pressure to the toner image on the recording sheet so that the toner image is fixed.

For preventing the transfer of the toner from the recording sheet to the fixing roller, which is in contact with the toner image on the recording sheet, when the recording sheet is moved between the fixing rollers, such a manner has been proposed, in which oil is applied and spread over this fixing roller. The oil applied to the fixing roller increases the releasability of the toner from the fixing roller, and in other words, promotes releasing of the toner from the fixing roller so that transfer of the toner onto the fixing roller can be suppressed.

When the oil is applied to the fixing roller, the fixing device is usually provided with an oil spreading roller in contact with the fixing roller. The oil supplied to the oil spreading roller is transported in accordance with rotation of the spreading roller, and thereby the oil is applied to and spread over the fixing roller.

If an excessively large amount of oil were applied to the fixing roller, disadvantages such as smearing of the recording sheet with the oil might occur. For preventing such disadvantages, a blade pressed against the fixing roller is employed for scraping off excessive oil. In some structures, the blade is pressed against the oil spreading roller.

In the above structure wherein the blade is pressed against the fixing roller for scraping off the oil, however, it is necessary to change the pressure or pressing force of the blade if the amount of oil left on the fixing roller is to be changed. For this purpose, a mechanical mechanism is required for changing the pressing force of the blade, which complicates the fixing device and increases the whole size and the cost. This is also true in the case where the blade is pressed against the oil spreading roller.

SUMMARY OF THE INVENTION

An object of the invention is to provide a liquid spreading device for spreading liquid over a target surface of a predetermined member, and particularly to provide a liquid spreading device allowing more easy control of a quantity of spread liquid than the prior art.

Another object of the invention is to provide a liquid spreading device for spreading liquid over a target surface of a predetermined member, and particularly to provide a liquid spreading device having a more compact and more inexpensive structure than the prior art.

Still another object of the invention is to provide a fixing device, in which a rotating member having an outer surface to be in contact with an unfixed toner image carried on a recording sheet is employed for fixing the unfixed toner image onto the recording sheet, and liquid such as oil is spread over the outer surface of the rotating member for increasing releasability between the toner image and the outer surface of the rotating member, and particularly to provide a fixing device allowing more easy control of the quantity of liquid on the rotating member than the prior art.

Further another object of the invention is to provide a fixing device, in which a rotating member having an outer surface to be in contact with an unfixed toner image carried on a recording sheet is employed for fixing the unfixed toner image onto the recording sheet, and liquid such as oil is spread over the outer surface of the rotating member for increasing releasability between the toner image and the outer surface of the rotating member, and particularly to provide a fixing device having a more compact and more inexpensive structure than the prior art.

The invention provides a liquid spreading device for spreading liquid over a target surface to be moved relatively to the liquid spreading device in a predetermined direction, including: a regulating member which is brought into contact with the target surface through the liquid; and a voltage applying unit for applying an electrical bias voltage across the regulating member and the target surface.

The invention provides a fixing device (a fixing device of a first type) for fixing a toner image onto an image bearing surface of a recording sheet, including: a rotating member having an outer surface to be in contact with the image bearing surface; a regulating member which is brought into contact with the outer surface of the rotating member through the liquid; and a voltage applying unit for applying an electrical bias voltage across the regulating member and the outer surface of the rotating member.

The invention provides a fixing device (a fixing device of a second type) for fixing a toner image onto an image bearing surface of a recording sheet, including: a rotating member having an outer surface to be in contact with the image bearing surface; a spreading roller which is provided for spreading liquid over the outer surface of the rotating member and has an outer surface in contact with the outer surface of the rotating member; a regulating member which is brought into contact with the outer surface of the spreading roller through the liquid; and a voltage applying unit for applying an electrical bias voltage across the regulating member and the outer surface of the spreading roller.

The foregoing and other objects, features, aspects and advantages of the present invention will become more apparent from the following detailed description when taken in conjunction with the accompanying drawings.

DESCRIPTION OF THE PREFERRED EMBODIMENTS

(I) Liquid Spreading Device

Figure 1:
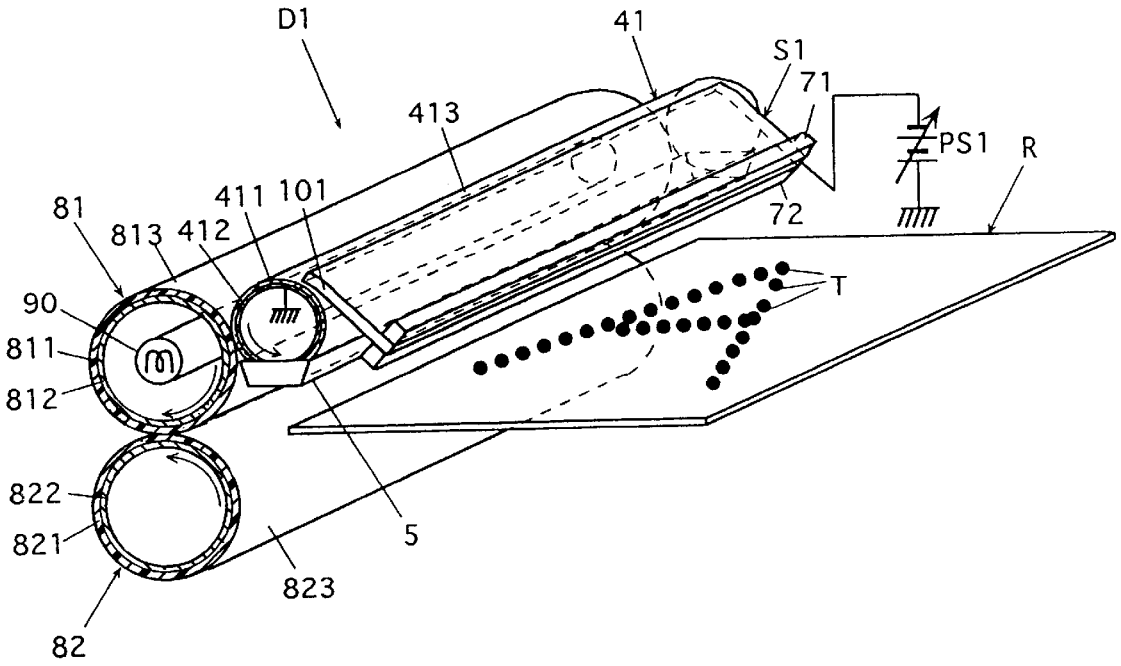
FIG. 1 is a schematic perspective view showing an example of a fixing device according to the invention.

The invention provides a liquid spreading device for spreading liquid over a target surface to be moved relatively to the liquid spreading device in a predetermined direction, including: a regulating member which is brought into contact with the target surface through the liquid; and a voltage applying unit for applying an electrical bias voltage across the regulating member and the target surface.

The liquid spreading device according to the invention is provided for spreading the liquid over the target surface of a predetermined member. More specifically, the liquid spreading device according to the invention is provided for controlling a quantity and/or a thickness of the liquid on the target surface. For example, the liquid is viscous. The target surface is to be driven to move relatively to the liquid spreading device by, e.g., a driving means. The target surface is to be moved relatively to the target surface in the redetermined direction, more specifically, relatively to the regulating member of the liquid spreading device in the predetermined direction.

The liquid spreading device according to the invention has the regulating member and the voltage applying unit.

The regulating member is brought into contact with the target surface through the liquid. For example, a portion of the regulating member may be brought into contact with the target surface through the liquid.

The voltage applying unit is provided for applying an electrical bias voltage across the regulating member and the target surface, or across the regulating member and the member having the target surface. For example, the voltage applying unit may apply a DC voltage as the bias voltage. The voltage applying unit may includes, for example, an electrical variable voltage source, i.e., a voltage source of an output voltage variable type. The voltage applying unit may include, for example, the electrical voltage source and an electrical variable resistor.

By applying the voltage across the regulating member and the target surface from the voltage applying unit, the regulating member can be electrostatically attracted onto the target surface with the liquid therebetween. The electrostatic attraction force of the regulating member can be controlled by the applied voltage. As the applied voltage is increased in absolute value, the electrostatic attraction force increases. The regulating member can regulate the liquid on the target surface. By controlling the force of electrostatically attracting the regulating member toward the target surface, and in other words, by controlling the voltage applied across the regulating member and the target surface, it is possible to control the quantity and film thickness (layer thickness) of the liquid on the target surface downstream from the regulating member in the predetermined direction.

In the liquid spreading device according to the invention, the pressing force of the regulating member against the target surface can be controlled without using a conventional mechanical mechanism. Thereby, the liquid spreading device according to the invention can have a more compact and more inexpensive structure than the prior art.

(I-1) The regulating member may selectively have, e.g., the following structures.

The regulating member may have a blade form. The regulating member of the blade form, i.e., the regulating blade may have a portion to be in contact with the target surface with the liquid therebetween. When it is not necessary to regulate the liquid on the target surface, the regulating blade may be spaced from the target surface. The regulating blade may be arranged near the target surface such that the bias voltage applied thereto brings the regulating blade into contact with the target surface. The regulating blade may have, for example, an end portion brought into contact with the target surface. The end portion, which is brought into contact with the target surface, of the regulating member may be either an upstream portion or a downstream portion of the blade in the predetermined direction (i.e., the moving direction of the target surface with respect to the liquid spreading device).

The regulating member may have a sheet form. The regulating member of the sheet form (i.e., the regulating sheet) may be, for example, a sheet having a large area compared with its thickness. The regulating sheet may be a flexible sheet having sufficient shape retention and elasticity, or may be a thin sheet (i.e., film-like sheet) having less self-retention and elasticity.

For example, a part of the regulating sheet may bring into contact with the target surface with the liquid therebetween. When it is not necessary to regulate the liquid on the target surface, the regulating sheet may be spaced from the target surface. The regulating sheet may be arranged near the target surface such that the bias voltage applied thereto brings the regulating sheet into contact with the target surface. Typically, the regulating sheet has a downstream portion in the predetermined direction, which is to be in contact with the target surface, and an upstream portion to be opposed to the target surface with a gap therebetween. In this structure, the regulating sheet may be supported in a cantilever fashion. The regulating sheet is, for example, two-dimensionally brought into contact with the target surface through the liquid. In other words, surface contact may be made between the regulating sheet and the target surface with the liquid therebetween.

The regulating sheet may have a thickness, e.g., from tens to hundreds of micrometers. An excessively large thickness of the regulating sheet impairs the adhesion thereof to the target surface through the liquid so that the regulating sheet cannot be in intimate contact with the curved target surface. An excessively small thickness results in an insufficient strength.

(I-2) The regulating member may selectively have the following structures described at the items (I-2-A), (I-2B) and (I-2C).

(I-2-A) The regulating member may include a first electrode layer.

The first electrode layer may be connected to the voltage applying unit.

In this case, for example, the first electrode layer may be partially brought into contact with the target surface through the liquid. For suppressing discharge from the first electrode layer to instruments and members arranged near the regulating member, an insulating layer may be arranged over the surface portion of the first electrode layer remote from the target surface.

(I-2B) The regulating member may include, in addition to the first electrode layer, an electrical insulating layer disposed between the first electrode layer and the target surface.

As described above, when the regulating member has the first electrode layer and the insulating layer, a second insulating layer may be arranged over the surface portion of the first electrode layer remote from the target surface for suppressing discharge from the first electrode layer to instruments and members arranged near the regulating member. For preventing discharge from side ends of the first electrode layer located on the opposite sides thereof in the direction crossing the moving direction of the target surface (i.e., the direction crossing the predetermined direction), the first electrode layer may be eliminated from the side ends of the regulating member.

As described above, when the regulating member has the first electrode layer and the insulating layer, the insulating layer may be partially brought into contact with the target surface through the liquid. The structure wherein the insulating layer is partially or entirely in contact with the target surface through the liquid can achieve the following advantage. Since the first electrode layer generating the electrostatic attraction force is not to be in contact with the target surface, the first electrode layer is prevented from being damaged, and can generate the intended electrostatic attraction force for a long term. The insulating layer to be in contact with the target surface is preferably made of a material having a high sliding property and a high resistance against wear. The material of the insulating layer having such property may be, e.g., fluororesin such as tetrafluoroethylene resin, synthetic resin such as polyimide, or synthetic rubber such as silicon rubber.

As described above, when the regulating member has the first electrode layer and the insulating layer, the first electrode layer may be divided into a plurality of portions in a direction orthogonal to the predetermined direction. In this case, the voltage applying unit may be provided with a plurality of control sections corresponding to the portions of the first electrode layer for applying the bias voltage to the divided portions of the first electrode layer, respectively. If the first electrode layer is divided into three or more, two or more groups each including the divided portion(s) may be formed so that each group may be supplied with the bias voltage independently of the other(s).

(I-2-C) The regulating member may include, in addition to the first electrode layer and the insulating layer, a second electrode layer arranged between the insulating layer and the target surface. The regulating member may have a multilayer structure formed of three or more layers, which include the first electrode layer, the insulating layer and the second electrode layer layered in this order.

For example, the second electrode layer may be partially in contact with the target surface through the liquid.

For suppressing discharge from the first electrode layer to instruments and members arranged near the regulating member, a second insulating layer may be arranged over the surface portion of the first electrode layer remote from the target surface. For preventing discharge from side ends of the first electrode layer located on the opposite sides thereof in the direction crossing the moving direction of the target surface (i.e., the direction crossing the predetermined direction), the first electrode layer may be eliminated from the side ends of the regulating member.

Similarly to the first electrode layer, the second electrode layer may be connected to the voltage applying unit for applying the bias voltage across the second electrode layer and the target surface. The first and second electrode layers may be connected to the common voltage applying unit, or may be connected to different voltage applying units, respectively. If the first electrode layer is to be connected to a DC power source, and the second electrode layer is likewise to be connected to a DC power source, a common DC power source may be connected to the first and second electrode layers. In the structure employing the common DC power source for the first and second electrode layers, the same voltage may be applied to the first and second electrode layers, or different voltages produced by, e.g., dividing the voltage by resistors may be applied to the first and second electrode layers, respectively.

Since the first and second electrode layers generate the electrostatic attraction forces, the total electrostatic attraction force can be large. Therefore, even if the liquid on the target surface has a high viscosity, the regulating member can sufficiently regulate the liquid to control accurately the quantity and others of the liquid on the target surface.

The first and/or second electrode layers may be divided into a plurality of portions in a direction orthogonal to the predetermined direction. In this case, the voltage applying unit, which is connected to the first electrode layer, may be provided with a plurality of control sections corresponding to the portions of the first electrode layer for applying the bias voltage to the divided portions of the first electrode layer, respectively. The voltage applying unit, which is connected to the second electrode layer, may be provided with a plurality of control sections corresponding to the portions of the second electrode layer for applying the bias voltage to the divided portions of the second electrode layer, respectively. If the electrode layer (first or second electrode layer) is divided into three or more, two or more groups each including the divided portion(s) may be formed so that each group may be supplied with the bias voltage independently of the other(s).

In any one of the regulating members described in the above items (I-2-A), (I-2-B) and (I-2-C), the electrode layer (first or second electrode layer) may be made of an electrically conductive material or an electrically resistant material (semiconductive material). The conductive material may be metal such as chrome, copper, gold, platinum, tungsten, indium or titanium, or may be ITO, carbon or the like. The resistant material may be fluororesin, such as polytetrafluoroethylene, ethylene-tetrafluorethylene copolymer (PETFE) or polyvinylidene fluoride (PVdF), containing a conductive material such as carbon dispersed therein. Alternatively, the resistant material may be synthetic resin, such as polyimide, polyester, polyamide, polyolefine or polycarbonate, containing a conductive material dispersed therein, or may be synthetic rubber such as urethane gum containing a conductive material dispersed therein. The resistant material may be fluorine resin to which an ion-conductive material is added, synthetic resin to which an ion-conductive material is added, or synthetic rubber to which an ion-conductive material is added. The electrode layer may have a portion made of the resistant material and the other portion made of the conductive material.

If the regulating member has the electrode layer(s) (first and/or second electrode layer) and the insulating layer, the regulating member may be prepared by overlapping the electrode layer(s) and the insulating layer with each other after preparing these layers in different steps, respectively. If the electrode layer is made of the resistant material, the electrode layer and the insulating layer may be integrally formed of a composite material having a gradient resistance. If the resistant material is used for the electrode layers, the electrode layer may be formed by spreading the resistant material onto the insulating layer. If the conductive material such as metal is used for the electrode layer, an appropriate film forming method such as sputtering may be used to form the electrode layer on the insulating layer. The film forming method such as sputtering may be used together with etching method such as photoetching for forming the electrode layer having an intended pattern on the insulating layer.

(I-3) The bias voltage applied from the voltage applying unit to the regulating member may be variable in accordance with environmental conditions and others. The applied voltage may be variable in proportion to change in conditions. The applied voltage may be variable in a stepwise fashion in accordance with change in conditions.

For changing the applied voltage, the voltage applying unit may include, for example, an electrical variable voltage source. The voltage applying unit may include, for example, an electrical voltage source and an electrical variable resistor.

(I-4) The following structures may be selectively employed for applying the liquid onto the target surface.

For example, a spreading rotary member may be employed for roughly spreading the liquid over the target surface. The spreading rotary member is brought into contact with the target surface. The spreading rotary member may have a roller form or an endless belt form retained around two or more rollers. The spreading rotary member may be arranged on an upstream side of the regulating member in the predetermined direction. For example, by arranging the spreading rotary member to be partially dipped into the liquid in a sump accommodating the liquid, and by rotating the spreading rotary member, e.g., in accordance with the movement of the target surface, the liquid can be roughly spread over the target surface by the spreading rotary member. The spreading rotary member may have a surface layer impregnated with the liquid in advance, whereby the liquid can be roughly spread over the target surface by rotating the spreading rotary member. The surface layer of the spreading rotary member may be, e.g., a sponge layer or a felt layer, whereby the surface layer can be impregnated with the liquid.

For example, the liquid spreading device may be provided with the sump accommodating the liquid, and the target surface may be partially or entirely dipped directly into the liquid in the sump, whereby the liquid can be roughly spread over the target surface by moving the target surface. In this case, the sump may be arranged on the side upstream, in the predetermined direction, to the regulating member, and the target surface may be dipped into the liquid in the sump on the side upstream to the regulating member.

For example, a liquid spray device may be employed for spraying the liquid to the target surface, whereby the liquid can be supplied onto the target surface.

For example, the liquid spreading device may employ a liquid drop supply device for dropping the liquid therefrom onto the target surface, whereby the liquid can be supplied onto the target surface.

(I-5) The liquid spreading device according to the invention may be used in a fixing device provided, e.g., in an electrophotographic image forming apparatus. Description will now be given on two types (first and second types) of fixing devices according to the invention. Each of the fixing devices of these types can be mounted in the electrophotographic image forming apparatus. Each of the fixing devices of these types is employed for fixing an unfixed toner image, carried on a recording sheet (a record member of a sheet form), onto the recording sheet.

(II) Fixing Devices of First and Second Types

The invention provides a fixing device (the fixing device of the first type) for fixing an unfixed toner image onto an image bearing surface of a recording sheet, including: a rotating member (rotary member) having an outer surface to be in contact with the image bearing surface of the recording sheet; a regulating member which is brought into contact with the outer surface of the rotating member through the liquid; and a voltage applying unit for applying an electrical bias voltage across the regulating member and the outer surface of the rotating member.

The invention provides a fixing device (the fixing device of the second type) for fixing an unfixed toner image onto an image bearing surface of a recording sheet, including: a rotating member (rotary member) having an outer surface to be in contact with the image bearing surface of the recording sheet; a spreading roller which is provided for spreading liquid over the outer surface of the rotating member and has an outer surface in contact with the outer surface of the rotating member; a regulating member which is brought into contact with the outer surface of the spreading roller through the liquid; and a voltage applying unit for applying an electrical bias voltage across the regulating member and the outer surface of the spreading roller.

The fixing device of the first type includes the rotating member, the regulating member and the voltage applying unit. The fixing device of the first type includes the liquid spreading device according to the invention. The matters already described with respect to the liquid spreading device of the above item (I) and others can be true also with respect to the fixing device of the first type. In the fixing device of the first type, as described below, the target surface, with which the regulating member is brought into contact, is an outer surface (outer peripheral surface) of the rotating member. In the fixing device of the first type, the voltage applying unit is provided for applying the bias voltage across the regulating member and the outer surface of the rotating member, or across the regulating member and the rotating member.

The fixing device of the second type includes the rotating member, the spreading roller, the regulating member and the voltage applying unit. The fixing device of the second type includes the liquid spreading device according to the invention. The matters already described with respect to the liquid spreading device of the above item (I) and others can be true also with respect to the fixing device of the second type. In the fixing device of the second type, as described below, the target surface, with which the regulating member is brought into contact, is an outer surface (outer peripheral surface) of the spreading roller. In the fixing device of the second type, the voltage applying unit is provided for applying the bias voltage across the regulating member and the outer surface of the spreading roller, or across the regulating member and the spreading roller.

(II-1) Description will now be given on the matters which are true in each of fixing devices of first and second types.

Each of the fixing devices of the first and second types is provided for fixing the unfixed toner image, carried on the image bearing surface of the recording sheet, onto the image bearing surface of the recording sheet.

The rotating member (rotary member) has an endless form. The rotating member may be of, e.g., a roller form or an endless belt form retained around two or more rollers. In the fixing operation, the rotating member is rotated so that the outer peripheral surface thereof moves in the predetermined direction.

In the fixing operation, the outer surface (outer peripheral surface) of the rotating member is to be in contact with the image bearing surface of the recording sheet.

In addition to the rotating member (first rotating member), the fixing device may be further provided with a second rotating member, whereby the fixing can be performed as follows. The second rotating member may be brought into contact with the first rotating member. The second rotating member may has an endless rotary form similarly to the first rotating member. By passing the recording sheet through the nip portion between the first and second rotating member while these rotating members are driven to rotate, the unfixed toner image can be fixed to the recording sheet. In the fixing operation, the rotating member to be in contact the unfixed toner image on the recording sheet is the first rotating member. A heat source(s) may be provided for at least one of the first and second rotating members so that the toner moving between these rotating members can be heated, whereby the unfixed toner image can be heated to be fixed onto the recording sheet. The heat source may be a heater such as a halogen lamp or the like, or may be a resistant heating member which generates heat when energized. One of the first and second rotating members may be pressed against the other.

In the following description, when the fixing device has the first and second rotating members as described above, the "rotating member" represents the "first rotating member" unless otherwise specified.

In the operation of fixing the unfixed toner image, e.g., as described above, the unfixed toner image is to be in contact with the outer peripheral surface of the rotating member. The liquid is applied to the outer peripheral surface of the rotating member as described below. Typically, the liquid is oil for increasing the releasability of the toner from the outer peripheral surface of the rotating member. The oil may be, e.g., silicon oil. The oil may have a high viscosity such as high-viscosity silicon oil. The high-viscosity silicon oil can reduce swelling of silicon rubber generally employed as a surface layer material of the rotating member, and thus can suppress change in diameter of the rotating member. Since the high-viscosity oil is sufficiently resistant to thermal degradation, and therefore can be used for a long term. In the fixing operation, the oil applied onto the outer peripheral surface of the rotating member can suppress transfer of the unfixed toner image, carried on the recording sheet, onto the rotating member so that good fixing can be performed.

Either of the fixing devices of the first and second types employs the foregoing liquid spreading device for spreading the liquid such as oil over the rotating member. More specifically, the regulating member and the voltage applying unit are employed for controlling the quantity, thickness and others of the liquid on the rotating member when the liquid on the rotating member comes into contact with the unfixed toner on the recording sheet.

In the fixing device of the first type, the liquid is regulated on the rotating member, and the quantity and others of the liquid on the rotating member is controlled. The control of the quantity of the liquid is performed before the liquid on the rotating member comes into contact with the recording sheet. For these purposes, the fixing device of the first type employs the regulating member brought into contact with the rotating member.

In the fixing device of the second type, the liquid is regulated on the spreading roller which is employed for spreading the liquid over the rotating member, and the quantity and others of the liquid on the spreading roller is controlled. Thus, the quantity and others of the liquid is controlled before the spreading roller spreads the liquid over the rotating member. For these purposes, the fixing device of the second type employs the regulating member brought into contact with the spreading roller.

Owing to the above structures, both the fixing device of the first and second types can suppress such a situation in the fixing operation that a large amount of liquid such as oil, carried on the rotating member, adheres onto the recording sheet and thereby smears the recording sheet.

The fixing device of the first and second types will now be described below more in detail.

(II-2) Fixing Device of the First Type

In the fixing device of the first type, as already described, the regulating member is brought into contact with the rotating member. In the fixing device of the first type, the target surface, with which the regulating member is brought into contact, is the outer surface (outer peripheral surface) of the rotating member. In the fixing operation, the rotating member may be driven to rotate such that the outer surface of the rotating member moves in the predetermined direction with respect to the regulating member. The liquid supplied onto the rotating member is transported in the predetermined direction by the movement of outer surface of the rotating member.

In the following description of the fixing device of the first type, the "predetermined direction" represents the moving direction of the outer surface of the rotating member. Also, "upstream in the moving direction of the outer surf ace of the rotating member" may be simply referred to as "upstream", hereinafter. Also, "downstream in the moving direction of the outer surface of the rotating member" may be simply referred to as "downstream", hereinafter.

As already described in the item (I-1), the regulating member may have, e.g., a blade form or a sheet form.

The regulating member may selectively have the structures already described in the item (I-2-A), (I-2-B) and (I-2-C). If the electrode layer (first and/or second electrode layer(s)) is divided into two or more in the direction crossing the predetermined direction, the division may be performed in the following manner. For example, the electrode layer may be divided into two or more depending on the width (i.e., length in the direction crossing the predetermined direction) of the recording sheet carrying the unfixed toner image. Each of the divided portions of the electrode layer may be supplied with a voltage corresponding to the width of the recording sheet, whereby it is possible to make a difference in quantity between the liquid on the region, with which the recording sheet is to be in contact, of the outer peripheral surface of the rotating member and the liquid on the region not in contact with the recording sheet.

As described in the item (I-3), the bias voltage applied to the regulating member from the voltage applying unit may be varied depending on, e.g., the environmental temperature, environmental humidity, the number of recording sheets subjected to the fixing operation, the kind of the unfixed toner image (i.e., whether the unfixed toner image on the recording sheet is a color toner image or a monochrome toner image), the density of the unfixed toner image carried on the recording sheet and/or the number of the recording sheets subjected to the continuous fixing. The voltage applied to the regulating member may be variable depending on a combination of two or more of these conditions.

The liquid may be supplied onto the outer surface of the rotating member, which is the target surface in the fixing device of the first type, in the manner as already described in the item (I-4). The liquid may be supplied to the position upstream to the position where the outer surface of the rotating member is in contact with the regulating member.

In the fixing device of the first type, the quantity and others of the liquid on the target surface, i.e., the outer surface of the rotating member can be controlled as the following manner.

The voltage applying unit applies the voltage across the regulating member and the rotating member, whereby the regulating member is electrostatically attracted to the rotating member. Therefore, by applying the voltage to the regulating member, and further by rotating the rotating member, it is possible to regulate the liquid on the rotating member which moves toward the position downstream from the regulating member. Thereby, it is possible to control the quantity of the liquid on the rotating member transported to the position downstream from the regulating member. Also, the quantity of the liquid on the rotating member can be uniform. By controlling the voltage applied to the regulating member, the force electrostatically attracting the regulating member toward the rotating member can be controlled so that it is possible to control the quantity (thickness) of the liquid on the rotating member which is transported to the position downstream from the regulating member.

By arranging the regulating member at the position downstream from the position where the liquid is supplied to the rotating member, and upstream to the position where the rotating member comes into contact with the unfixed toner image on the recording sheet, the regulating member can control the quantity and others of the liquid supplied onto the rotating member before the liquid comes into contact with the unfixed toner image on the recording sheet.

When the regulating member has a sheet form, and further when the regulating member, i.e., the regulating sheet has a downstream portion in contact with the rotating member, the downstream portion of the regulating sheet is electrostatically attracted toward the rotating member, and is pulled downstream in accordance with movement of the outer peripheral surface of the rotating member. Thereby, the regulating sheet can be in close contact with the curved outer peripheral surf ace of the rotating member with the liquid therebetween without wrinkles and others. Accordingly, even if the outer peripheral surface of the rotating member undulates or vibrates during movement, the regulating sheet can be in stable contact with the outer peripheral surface of the rotating member with the liquid therebetween, which allows more stable control of the quantity of the liquid on the rotating member.

As one of the examples of the fixing device of the first type, the fixing device may have the following structure.

A fixing device including a first fixing rotary member (i.e., first rotary member for fixing) and a second fixing rotary member opposed to the first fixing rotary member; provided for fixing an unfixed toner image carried on a recording sheet onto the recording sheet by passing the recording sheet between the first and second fixing rotary members; wherein the first fixing rotary member is to be in contact with the unfixed toner image carried on the recording sheet; wherein oil for increasing releasability of the toner is to be supplied onto the outer peripheral surface of the first fixing rotary member, and further including:

an oil spreading rotary member in contact with the first fixing rotary member, and capable of carrying the oil on its outer peripheral surface for spreading the oil over the outer peripheral surface of the first fixing rotary member; and an oil regulating sheet having a portion to be in contact with the outer peripheral surface of the first fixing rotary member, including an electrode layer to be connected to an electric power source, having a supported portion spaced from the outer peripheral surface of the first fixing rotary member, having a contact portion located downstream from the supported portion for contact with the outer peripheral surface of the first fixing rotary member, wherein the contact portion is located downstream, in the outer peripheral surface moving direction of the first fixing rotary member, from a position of contact between the first fixing rotary member and the oil spreading rotary member, and wherein the contact portion is located upstream to a position between the opposed portions of the first and second fixing rotary members.

(II-3) Fixing Device of the Second Type

In the fixing device of the second type, as already described, the regulating member is brought into contact with the spreading roller. In the fixing device of the second type, the target surface, with which the regulating member is brought into contact, is the outer surface (outer peripheral surface) of the spreading roller. In the fixing operation, the spreading roller may be driven to rotate such that the outer surface of the spreading roller moves in the predetermined direction with respect to the regulating member. The liquid supplied onto the spreading roller is transported in the predetermined direction by the movement of outer surface of the spreading roller, and thereby is spread over the rotating member.

In the following description of the fixing device of the second type, "the predetermined direction" represents the moving direction of the outer surface of the spreading roller. Also, "upstream in the moving direction of the outer surface of the spreading roller" may be simply referred to as "upstream", hereinafter. Also, "downstream in the moving direction of the outer surface of the spreading roller" may be simply referred to as a "downstream", hereinafter.

As already described in the item (I-1), the regulating member may have, e.g., a blade form or a sheet form.

The regulating member may selectively have the structures already described in the item (I-2-A), (I-2-B) and (I-2-C). If the electrode layer (first and/or second electrode layer(s)) is divided into two or more in the direction crossing the predetermined direction, the division may be performed in the following manner. For example, the electrode layer may be divided into two or more depending on the width (i.e., length in the direction crossing the predetermined direction) of the recording sheet carrying the unfixed toner image. Each of the divided portions of the electrode layer is supplied with a voltage corresponding to the width of the recording sheet, whereby it is possible to make a difference in quantities of the liquid on regions, arranged in the direction crossing the predetermined direction, of the outer peripheral surface of the spreading roller, and thereby it is possible to make a difference in quantity between the liquid on the region of the outer peripheral surface of the rotating member in contact with the recording sheet and the liquid on the region of the outer peripheral surface of the rotating member not in contact with the recording sheet.

As described in the item (I-3), the bias voltage applied to the regulating member from the voltage applying unit may be varied depending on, e.g., the environmental temperature, environmental humidity, the number of recording sheets subjected to the fixing operation, the kind of the unfixed toner image (i.e., whether the unfixed toner image on the recording sheet is a color toner image or a monochrome toner image), the density of the unfixed toner image carried on the recording sheet and/or the number of the recording sheets subjected to the continuous fixing. The voltage applied to the regulating member may be variable depending on a combination of two or more of these conditions.

The liquid may be supplied onto the outer surface of the spreading roller, which is the target surface in the fixing device of the second type, in the manner as already described in the item (I-4). The liquid may be supplied to the position upstream to the position where the outer surface of the spreading roller is in contact with the regulating member.

In the fixing device of the second type, the quantity and others of the liquid on the outer surface of the rotating member can be controlled as following manner.

In the fixing device of the second type, by controlling or adjusting the quantity of the liquid on the spreading roller before the spreading roller spreads the liquid over the rotating member, the quantity of the liquid spread by the spreading roller over the rotating member can be adjusted, and thereby the quantity of the liquid on the regulating member can be adjusted. Accordingly, the regulating member may be arranged at the position upstream to the position of contact between the spreading roller and the rotating member (i.e., the position where the spreading roller spreads the liquid over the rotating member) and downstream from the position where the liquid is supplied onto the spreading roller.

The voltage applying unit applies the voltage across the regulating member and the spreading roller, whereby the regulating member is electrostatically attracted to the spreading roller. Therefore, by applying the voltage to the regulating member, and further by rotating the spreading roller, it is possible to regulate the liquid on the spreading roller which moves toward the position downstream from the regulating member. Thereby, it is possible to control the quantity of the liquid on the spreading roller transported to the position downstream from the regulating member. Also, the quantity of the liquid on the spreading roller can be uniform. By controlling the voltage applied to the regulating member, the force electrostatically attracting the regulating member toward the spreading roller can be controlled so that it is possible to control the quantity (thickness) of the liquid on the spreading roller which is transported to the position downstream from the regulating member.

By spreading the liquid, of which quantity is thus adjusted, on the spreading roller over the rotating member, the quantity of liquid on the rotating member can be regulated appropriately. Thereby, the liquid of which quantity is appropriately regulated can be present on the rotating member when the rotating member comes into contact with the recording sheet carrying the unfixed toner.

When the regulating member has a sheet form, and further when the regulating member, i.e., the regulating sheet has a downstream portion in contact with the spreading roller, the downstream portion of the regulating sheet is electrostatically attracted toward the spreading roller, and is pulled downstream in accordance with movement of the outer peripheral surface of the spreading roller. Thereby, the regulating sheet can be in close contact with the curved outer peripheral surface of the spreading roller with the liquid therebetween without wrinkles and others. Accordingly, even if the outer peripheral surface of the spreading roller undulates or vibrates during movement, the regulating sheet can be in stable contact with the outer peripheral surface of the spreading roller with the liquid therebetween, which allows more stable control of the quantity of the liquid on the spreading roller, and thereby more stable control of the quantity of the liquid on the rotating member.

As one of the examples of the fixing device of the second type, the fixing device may have the following structure.

A fixing device including a first fixing rotary member and a second fixing rotary member opposed to the first fixing rotary member; provided for fixing an unfixed toner image carried on a recording sheet onto the recording sheet by passing the recording member between the first and second fixing rotary members; wherein the first fixing rotary member is to be in contact with the unfixed toner image carried on the recording sheet, wherein oil for increasing releasability from the toner is supplied onto the outer peripheral surface of the first fixing rotary member; and further including:

an oil spreading rotary member in contact with the first fixing rotary member for spreading the oil supplied onto its outer peripheral surface over the outer peripheral surface of the first fixing rotary member; and an oil regulating sheet having a portion in contact with the outer peripheral surface of the oil spreading rotary member, including an electrode layer to be connected to an electric power source, having a supported portion spaced from the outer peripheral surface of the oil spreading rotary member, having a contact portion located downstream from the supported portion for contact with the outer peripheral surface of the oil spreading rotary member, wherein the contact portion is located downstream, in the outer peripheral surface moving direction of the oil spreading rotary member, from a position of supply of the oil, and wherein the contact portion is located upstream to a position of contact between the oil spreading rotary member and the first fixing rotary member.

(III) Examples of the fixing device of the invention will now be described below with reference to the drawings. Each fixing device described below is provided with the liquid spreading device according to the invention.

Figure 2:
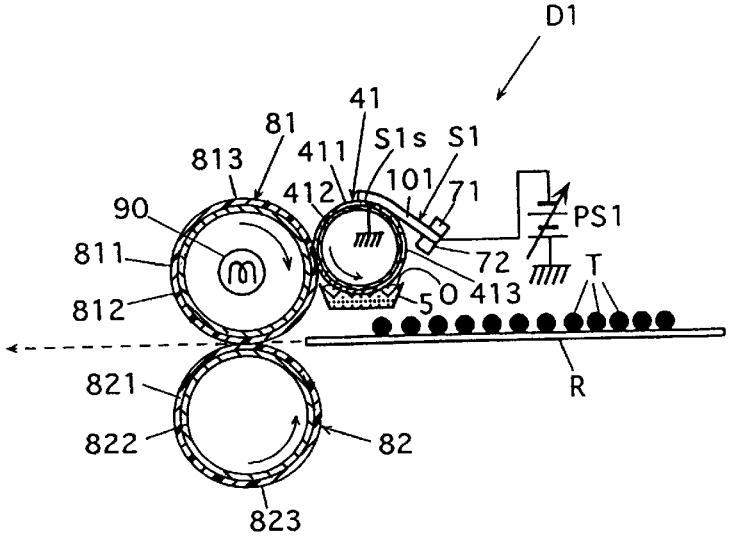
FIG. 2 is a schematic cross section of the fixing device shown in FIG. 1.

(III-1) FIG. 1 is a schematic perspective view of the fixing device according to the invention, and FIG. 2 is a schematic cross section of the fixing device shown in FIG. 1.

A fixing device D1 shown in FIGS. 1 and 2 is provided in an electrophotographic image forming apparatus. The fixing device D1 is provided for fixing unfixed toner T, which is transferred onto a recording sheet R (i.e., a recording member of a sheet form) by the electrophotographic image forming process, onto the recording sheet R. The unfixed toner T carried on the recording sheet R forms an image.

The fixing device D1 has two fixing rollers 81 and 82 as rotating members for fixing. The fixing roller 82 is opposed to the fixing roller 81. The fixing device D1 further has an oil spreading roller 41 as an oil spreading rotary member for spreading oil over an outer peripheral surface 813 of the fixing roller 81, an oil sump 5 for accommodating or storing oil O, an oil regulating sheet S1 in contact with the oil spreading roller 41 and an electric power source PS1.

The fixing roller 81 is rotatably supported by a support device (not shown). The fixing roller 81 can be rotated by a drive device including an electric motor and a drive power transmission mechanism (both not shown). When the fixing roller 81 is rotated, its outer peripheral surface 813 rotationally moves clockwise in FIG. 2.

The fixing roller 81 is formed of a hollow cylindrical core roller 812 and a dielectric layer 811 formed on the outer peripheral surface of the core roller 812. The core roller 812 in this example is made of aluminum. The core roller 812 is electrically conductive. The dielectric layer 811 in this example is made of polytetrafluoroethylene having a sufficient heat resistance and a sufficient releasability.

A heater 90 is arranged within the hollow fixing roller 81. The heater 90 is supported in a fixed position by a support device (not shown). The heater 90 in this example is a halogen lamp. The heater 90 can heat the fixing roller 81 from its inner side. The fixing roller 81 is a so-called heating roller.

The heating roller 82 is rotatably supported by a support device (not shown). An outer peripheral surface 823 of the fixing roller 82 is in contact with the outer peripheral surface 813 of the fixing roller 81. The fixing roller 82 is pushed toward the fixing roller 81 by a pushing device (not shown). The fixing roller 82 is a so-called pressure roller. When the fixing roller 81 is driven, the fixing roller 82 is driven by the rotating fixing roller 81, or by the recording sheet R moving between the fixing rollers 81 and 82 so that the outer peripheral surface 823 rotationally moves counterclockwise in FIG. 2.

The fixing roller 82 is formed of a hollow cylindrical core roller 822 and a dielectric layer 821 formed on the outer peripheral surface of the core roller 822. The core roller 822 in this example is made of aluminum. The core roller 822 is electrically conductive. The dielectric layer 821 in this example is made of silicon rubber having a high heat resistance.

The oil spreading roller 41 is rotatably supported by a support device (not shown). The oil spreading roller 41 has an outer peripheral surface 413 in contact with the outer peripheral surface 813 of the fixing roller 81. The oil sump 5 accommodating the oil O is arranged under the oil spreading roller 41. The oil O in this example is silicon oil. The oil spreading roller 41 is partially immersed in the oil O in the oil sump 5.

The oil spreading roller 41 is formed of a hollow cylindrical core roller 412 and a dielectric layer 411 formed on the outer peripheral surface of the core roller 412. The core roller 412 in this example is made of aluminum. The core roller 412 is electrically conductive. The dielectric layer 411 in this example is made of silicon rubber.

When the fixing roller 81 is driven, the oil spreading roller 41 is driven to rotate by the rotating fixing roller 81. When the oil spreading roller 41 rotates, its outer peripheral surface 413 rotationally moves counterclockwise in FIG. 2. When oil spreading roller 41 rotates, the oil O in the oil sump 5 is supplied onto the outer peripheral surface 413. The oil spreading roller 41 and the fixing rollers 81 and 82 have rotation axes parallel to each other. The oil spreading roller 41 may be driven by a drive device other than the drive device for the fixing roller 81.

In the following description of the fixing device D1, "the moving direction of the outer peripheral surface 413 of the oil spreading roller 41 in the fixing operation" may be simply referred to as "the peripheral surface moving direction". Also, "upstream in the moving direction of the outer peripheral surface 413 of the oil spreading roller 41 in the fixing operation" may be simply referred to as "upstream", hereinafter. Further, "downstream in the moving direction of the outer peripheral surface 413 of the oil spreading roller 41 in the fixing operation" may be simply referred to as "downstream", hereinafter.

The oil regulating sheet S1 is arranged in the position opposed to the outer peripheral surface 413 of the oil spreading roller 41, and particularly in the position downstream from the position where the outer peripheral surface 413 is immersed in the oil O in the oil sump 5, and upstream to the position where the outer peripheral surface 413 is in contact with the outer peripheral surface 813 of the fixing roller 81.

The oil regulating sheet S1 is a sheet having a sufficiently large area compared with the thickness. The oil regulating sheet S1 in this embodiment is a substantially rectangular flexible sheet.

The oil regulating sheet S1 is supported by two supporting members 71 and 72, which hold the upstream end portion of the sheet S1 therebetween and extend in the rotation axis direction of the oil spreading roller 41. The support members 71 and 72 are supported by supporting means (not shown). The upstream end portion of the oil regulating sheet S1 is spaced from the outer peripheral surface 413 of the oil spreading roller 41 by a predetermined distance, and thus is not in contact with the outer peripheral surface 413. The upstream end portion of the oil regulating sheet S1 is opposed to the outer peripheral surface 413. The oil regulating sheet S1 is curved so that a surface S1*s*, downstream from the supported upstream end portion, is in contact with the outer peripheral surface 413. The oil regulating sheet S1 is two-dimensionally in contact with the outer peripheral surface 413. In other words, the oil regulating sheet S1 is in surface-contact with the outer peripheral surface 413. The surface S1*s* of the oil regulating sheet S1 is in contact with a portion of the outer peripheral surface 413 of the oil spreading roller 41 at the position downstream from the position where the outer peripheral surface 413 is immersed in the oil O in the oil sump 5, and upstream to the position where the outer peripheral surface 413 is in contact with the outer peripheral surface 813 of the fixing roller 81.

The oil regulating sheet S1 is formed of, in this example, a single layer, i.e., an electrode layer 101. The electrode layer 101 in this example is made of polyimide, i.e., an electrically resistant material containing an electrically conductive material dispersed therein. In this example, the electrode layer 101 has a surface resistance of $10^6$ Ω/□.

The electrode layer 101 is connected to the power source PS1.

The power source PS1 can apply a DC voltage across the electrode layer 101 of the oil regulating sheet S1 and the electrically conductive core roller 412 of the oil spreading roller 41. The power source PS1 in this example applies a negative voltage to the electrode layer 101. The electrode layer 101 may be supplied with a positive voltage. The power source PS1 is of an output variable type.

Figure 3:
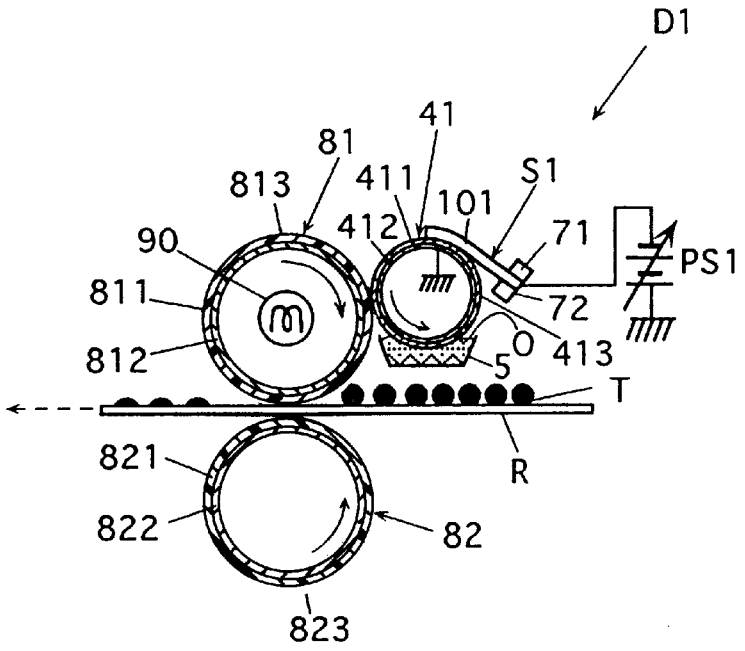
FIG. 3 shows a manner of fixing by the fixing device shown in FIG. 1.

When fixing the unfixed toner T onto the recording sheet R by the fixing device D1, the heater 90 heats the fixing roller 81 to a predetermined fixing temperature, the drive device (not shown) drives the fixing roller 81 to rotate, and the recording sheet R carrying the unfixed toner T is moved or passed between the fixing rollers 81 and 82 as shown in FIG. 3. The recording sheet R is moved between the fixing rollers 81 and 82 such that the unfixed toner T come into contact with the fixing roller 81. In this fixing operation, the electrode layer 101 of the oil regulating sheet S1 is supplied with a voltage from the power source PS1.

The unfixed toner T carried on the recording sheet R receives the heat and pressure, and is fixed onto the recording sheet R while it is moving between the fixing rollers 81 and 82. In this fixing operation, the oil spreading roller 41 rotates in accordance with rotation of the fixing roller 81, and the outer peripheral surface 413 thereof is supplied with the oil O from the oil sump 5. Thereby, the oil spreading roller 41 spreads the oil O over the outer peripheral surface 813 of the fixing roller 81. The oil O on the outer peripheral surface 813 of the fixing roller 81 can suppress transfer of the unfixed toner T on the recording sheet R onto the outer peripheral surface 813 when the recording sheet R moves between the fixing rollers 81 and 82. Since the transfer of the unfixed toner T onto the outer peripheral surface 813 of the fixing roller 81 can be suppressed, the toner image can be fixed onto the recording sheet R without breaking the image formed by the unfixed toner T. Thus, the fixing device D1 of the invention can perform good fixing of the unfixed toner image onto the recording sheet. Further, the quantity of the oil on the outer peripheral surface 813 of the fixing roller 81 is appropriately regulated by the oil regulating sheet S1 in contact with the oil spreading roller 41 before the oil is spread over the fixing roller 81 by the oil spreading roller 41 as described below. Therefore, it is possible to suppress smearing of the recording sheet R and other disadvantages which may be caused by an excessively large quantity of the oil on the fixing roller 81. This allows good fixing by the fixing device D1.

Description will now be given on the manner in which the oil regulating sheet S1 regulates the quantity of the oil before the oil spreading roller 41 applies the oil O over the fixing roller 81.

When the recording sheet R moves between the fixing rollers 81 and 82, the power source PS1 applies the voltage to the electrode layer 101 of the oil regulating sheet S1. Thereby, the electrode layer 101 is electrostatically attracted toward the outer peripheral surface 413 of the rotating oil spreading roller 41. Thereby, the surface S1*s* of the downstream end portion of the oil regulating sheet S1 can come into contact with the outer peripheral surface 413 or the oil O on the outer peripheral surface 413 while receiving the electrostatic attraction force. When the oil is present on the outer peripheral surface 413, the surface S1*s* of the oil regulating sheet S1 can be in contact with the outer peripheral surface 413 through the oil. The surface S1*s* is pulled downstream by the moving outer peripheral surface 413 while being electrostatically attracted toward the outer peripheral surface 413. Therefore, the surface S1*s* is in close contact with the curved outer peripheral surface 413 or the oil O thereon without causing slack and wrinkles. Further, the surface S1*s* is in close contact with the curved outer peripheral surface 413 or the oil O thereon.

Thereby, the oil regulating sheet S1 can scrape off the oil O supplied from the oil sump 5 onto the outer peripheral surface 413 of the oil spreading roller 41 so that an excessively large amount of oil may not be transported downstream from the oil regulating sheet S1. Also, the oil O on the outer peripheral surface 413 can have a uniform thickness. As already described, the oil regulating sheet S1 is arranged upstream to the position of contact between the oil spreading roller 41 and the fixing roller 81. Therefore, the oil O of the regulated quantity can be spread over the outer peripheral surface 813 of the fixing roller 81.

Since a portion of the surface of the oil regulating sheet S1 is in contact with the outer peripheral surface 413 of the oil spreading roller 41 with the oil O therebetween, a distance between the oil regulating sheet S1 and the outer peripheral surface 413 can be kept even if the moving outer peripheral surface 413 undulates or vibrates. Accordingly, the quantity (film thickness) of the oil O on the outer peripheral surface 413 can be uniform.

The quantity of the oil O spread over the fixing roller 81 by the oil spreading roller 41 can be easily controlled by controlling the electrostatic attraction force applied to the oil regulating sheet S1 toward the outer peripheral surface 413 of the oil spreading roller 41, and in other words, by controlling the voltage applied to the electrode layer 101 of the oil regulating sheet S1. Accordingly, it is not necessary for the fixing device D1 of the invention to provide a mechanical mechanism for changing the pressing or attraction force of the regulating member (i.e., regulating sheet in the fixing device D1) toward the oil spreading roller, compared with the conventional fixing device wherein a pressing force of the regulating member (e.g., a blade) is controlled by a mechanical mechanism for controlling the quantity of the oil. Accordingly, the fixing device D1 of the invention can regulate the oil quantity by a more simple and compact structure than the conventional fixing device. Also, the fixing device D1 can be more inexpensive than the conventional fixing device.

(III-2) In the fixing device D1 described above, the oil regulating sheet regulates the quantity of the oil on the outer peripheral surface of the oil spreading rotary member before the oil spreading rotary member spreads the oil over the fixing rotary member. Alternatively, regulation of the oil quantity may be performed on the outer peripheral surface of the fixing rotary member after the oil spreading rotary member spreads the oil over the fixing rotary member. An example of this structure is employed in a fixing device D2 shown in FIG. 4.

In the figures showing fixing devices D2–D7 which will be described below and the figures showing the fixing device D1 already described, parts and portions having the substantially same functions and/or operations bear the same reference numbers or characters. In the figures showing the fixing devices D2–D7, support members supporting the oil regulating members are not shown.

Similarly to the fixing device D1, the fixing device D2 has the two fixing rotary members, i.e., the fixing rollers 81 and 82 as well as the oil spreading rotary member, i.e., oil spreading roller 41, and the oil sump 5 accommodating the oil O. The fixing rollers 81 and 82 are in contact with each other. The fixing roller 81 is in contact with the oil spreading roller 41. The oil spreading roller 41 is partially immersed in the oil O in the oil sump 5. The heater 90 is arranged within the hollow fixing roller 81.

In the following description of the fixing device D2, "the moving direction of the outer peripheral surface 813 of the fixing roller 81 in the fixing operation" may be simply referred to as "the peripheral surface moving direction". Also, "upstream in the moving direction of the outer peripheral surface 813 of the fixing roller 81 in the fixing operation" may be simply referred to as "upstream", hereinafter. Further, "downstream in the moving direction of the outer peripheral surface 813 of the fixing roller 81 in the fixing operation" may be simply referred to as "downstream", hereinafter.

In the fixing device D2, the oil regulating sheet S1 is in contact with the outer peripheral surface 813 of the fixing roller 81. The oil regulating sheet S1 is arranged in the position opposed to the outer peripheral surface 813, and particularly in the position downstream from the position where the oil spreading roller 41 spreads the oil O over the outer peripheral surface 813, and upstream to the position where the outer peripheral surface 813 is in contact with the outer peripheral surface 823 of the fixing roller 82.

The oil regulating sheet S1 has the upstream end portion, in the moving direction of the outer peripheral surface 813 of the fixing roller 81, which is supported in the position spaced by a predetermined distance from the outer peripheral surface 813. The oil regulating sheet S1 has a surface downstream from the supported portion and in contact with the outer peripheral surface 813.

The electrode layer 101 of the oil regulating sheet S1 is connected to the power source PS1. The power source PS1 can apply a DC voltage across the electrode layer 101 and the core roller 812 of the fixing roller 81.

The fixing device D2 can fix the unfixed toner T carried on the recording sheet R onto the recording sheet R, similarly to the fixing device D1. In the fixing operation, the electrode layer 101 of the oil regulating sheet S1 is supplied with the voltage from the power source PS1.

When the recording sheet R is moved between the fixing rollers 81 and 82, the voltage is applied to the electrode layer 101 of the oil regulating sheet S1 so that the electrode layer 101 is electrostatically attracted toward the outer peripheral surface 813 of the rotating fixing roller 81. Thereby, the surface of the downstream portion of the oil regulating sheet S1 can be in contact with the outer peripheral surface 813 or the oil thereon while being electrostatically attracted toward the outer peripheral surface 813. Therefore, this downstream surface of the oil regulating sheet S1 can be in contact with the outer peripheral surface 813 or the oil O thereon without causing slack and wrinkles. Further, the downstream surface of the oil regulating sheet S1 can be in close contact with the curved outer peripheral surface 813 or the oil O thereon.

Thereby, the oil regulating sheet S1 can scrape off the oil O spread by the oil spreading roller 41 over the outer peripheral surface 813 of the rotating fixing roller 81 so that an excessively large amount of oil may not be transported downstream. Also, the oil O on the outer peripheral surface 813 can have a uniform thickness. Thereby, the quantity of the oil O can be appropriately controlled when the oil O on the outer peripheral surface 813 comes into contact with the recording sheet R carrying the unfixed toner T.

Since a portion of the surface of the oil regulating sheet S1 is in contact with the outer peripheral surface 813 of the fixing roller 81 with the oil O therebetween, a distance between the oil regulating sheet S1 and the outer peripheral surface 813 can be kept even if the moving outer peripheral surface 813 undulates or vibrates. Accordingly, the quantity (film thickness) of the oil O on the outer peripheral surface 813 can be uniform.

Owing to the above, the fixing device D2 can likewise perform good fixing.

In the fixing device D2, the quantity of the oil O on the outer peripheral surface 813 of the fixing roller 81 can be easily controlled by controlling the electrostatic attraction force applied to the oil regulating sheet S1 toward the outer peripheral surface 813 of the fixing roller 81, and in other words, by controlling the voltage applied to the electrode layer 101 of the oil regulating sheet S1.

Figure 5:
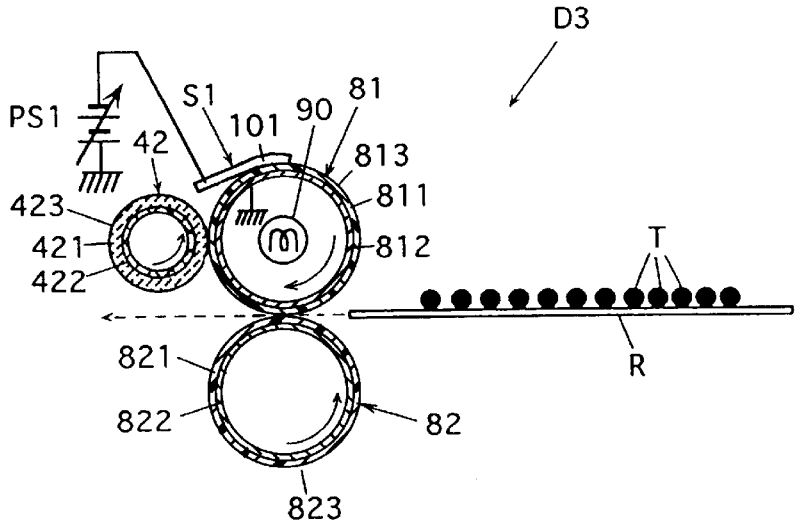
FIG. 5 is a schematic cross section showing still another example of the fixing device according to the invention.

When the quantity of the oil on the outer peripheral surface of the fixing rotary member is controlled by the oil regulating member in contact with the fixing rotary member after the oil spreading rotary member spreads the oil over the fixing rotary member, as is done in the fixing device D2, the surface layer of the oil spreading rotary member may be impregnated with the oil instead of the structure wherein the oil is supplied to the outer peripheral surface of the oil spreading rotary member. An example of this structure is employed in the fixing device D3 shown in FIG. 5.

The fixing device D3 is provided with an oil spreading roller 42 instead of the oil spreading roller 41 and the oil sump 5 in the fixing device D2.

The fixing device D3 has the two fixing rollers 81 and 82 as the fixing rotary members as well as the oil spreading roller 42 as the oil spreading rotary member. The fixing rollers 81 and 82 are in contact with each other. The fixing roller 81 is in contact with the oil spreading roller 42. The oil regulating sheet S1 is in contact with the fixing roller 81 in a position similar to the position where the oil regulating sheet in the fixing device D2 makes contact.

The oil spreading roller 42 is formed of a hollow cylindrical core roller 422 and a felt layer 421 formed on the outer peripheral surface of the core roller 422. The felt layer 421 is impregnated with oil in advance.

In the fixing device D3, the oil in the felt layer 421 of the oil spreading roller 42 exudes in the position where the oil spreading roller 42 is in contact with the fixing roller 81, and is applied to the outer peripheral surface 813 of the fixing roller 81. Except for the above, the fixing device D3 performs the fixing similarly to the fixing device D2. Accordingly, the fixing device D3 can likewise perform good fixing. Further, the quantity of the oil on the outer peripheral surface 813 of the fixing roller 81 can be easily controlled.

Figure 6:
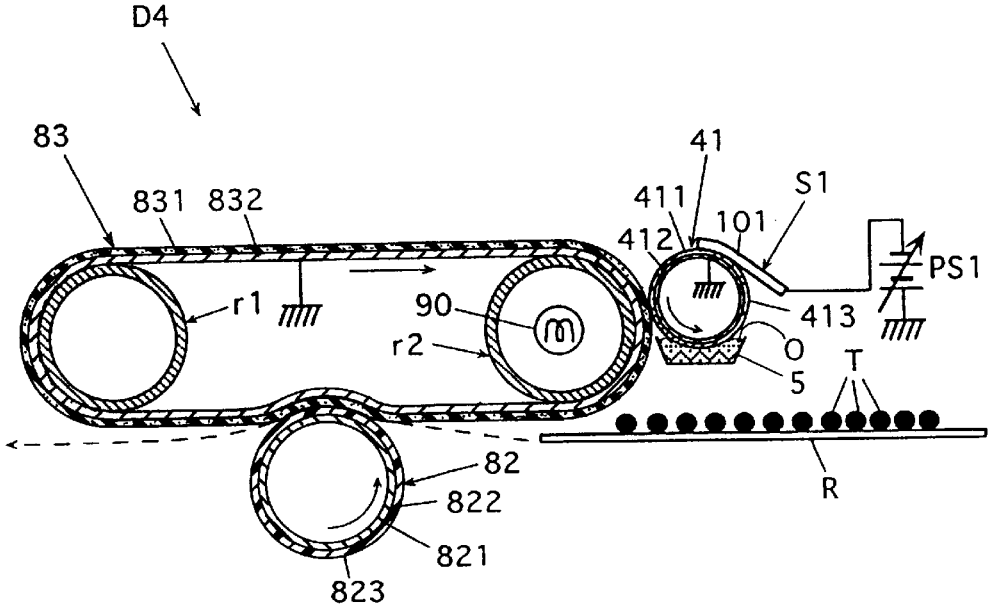
FIG. 6 is a schematic cross section showing yet another example of the fixing device according to the invention.

In the fixing devices D1–D3, each of the two fixing rotary members and the oil spreading rotary member are of the roller form. Alternatively, the fixing rotary member and/or the oil spreading rotary member may be of an endless belt form. An example of this structure is employed in the fixing device D4 shown in FIG. 6.

The fixing device D4 employs a fixing belt 83 instead of the fixing roller 81 in the fixing device D1.

The fixing belt 83 is retained around a roller r2 which is driven to rotate and a roller r1.

The fixing belt 83 is formed of a metal core belt 832 and a dielectric layer 831 formed over the core belt 832. The dielectric layer 831 in this example is made of silicon rubber having a high heat resistance and a high releasability. The fixing roller 82 is pressed against the fixing belt 83. The heater 90 is arranged within the hollow roller r2. The fixing belt 83 is in contact with the oil spreading roller 41.

The fixing device D4 can perform fixing similarly to the fixing device D1. The fixing device D4 can provide a large nip region between the fixing belt 83 and the fixing roller 82 compared with the fixing device D1 and other so that larger heat can be applied easily to the unfixed toner T, and therefore the fixing device D4 can perform further improved fixing.

In the fixing devices D1–D4 described above, the electrostatic force attracting the oil regulating sheet toward the outer peripheral surface, with which the oil regulating sheet is in contact, can be changed by changing the voltage applied to the electrode layer of the oil regulating sheet as described above. Thereby, it is possible to control the quantity of the oil which is present on the outer peripheral surface of the fixing rotary member when it comes into contact with the recording sheet. By increasing the voltage in absolute value applied to the electrode layer of the oil regulating sheet, the electrostatic attraction force increases, and the quantity of the oil can be reduced. The voltage applied to the electrode layer may be changed in accordance with the change in the following conditions (1)–(5). The voltage applied to the electrode layer may be changed in proportion to the change in these conditions. The voltage applied to the electrode layer may be changed in a stepwise fashion in accordance with change in these conditions.

(1) The voltage may be changed in accordance with an ambient or environmental temperature. When the temperature is high, the viscosity of the oil decreases, and therefore the voltage may be decreased in absolute value for increasing the quantity of the oil.

(2) The voltage may be changed in accordance with the number of recording sheets passed between the two fixing rotary members. For example, if the surface layer of the fixing rotary member in contact with the unfixed toner image on the recording sheet has contained a small amount of oil, the amount of oil contained in the surface layer of the fixing rotary member decreases as the fixing operation is repeated, and in other words, the number of sheets passed between the fixing rotary members increases. In this case, the surface layer of the fixing rotary member is deteriorated, and the releasability of the toner is impaired as the fixing operation is repeated. For preventing this, the absolute value of the applied voltage may be decreased for increasing the quantity of the oil when the number of sheets passed between the fixing rotary members reaches a large value. The absolute value of the applied voltage may be decreased in a stepwise fashion in accordance with the number of the recording sheets passed between the fixing rotary members. For example, the absolute value of the applied voltage may be decreased in a stepwise fashion such that the absolute value of the voltage is decreased every time 5000 recording sheets are passed between the fixing rotary members.

(3) The applied voltage may be changed depending on whether the unfixed toner image carried on the recording sheet is a color toner image or a monochrome toner image. When the unfixed toner image is a color toner image, the quantity of the toner on the recording sheet is generally larger than that in the case of the monochrome toner image, and thereby the quantity of the oil taken into the toner image increases. Therefore, when the unfixed toner image is a color toner image, the absolute value of the applied voltage may be reduced to increase the quantity of the oil.

(4) The applied voltage may be changed depending on the density of the unfixed toner image carried on the recording sheet. When the unfixed toner image has a high density, and in other words, when the unfixed toner on the recording sheet is large in quantity, the quantity of the oil taken into the toner increases. Therefore, when the unfixed toner image has a high density, the absolute value of the applied voltage may be reduced for increasing the quantity of the oil.

(5) The applied voltage may be changed in accordance with the number of the recording sheets which are continuously passed between the two fixing rotary members. When the recording sheets are continuously fed between the fixing rotary members, the quantity of the oil decrease with increase in number of the recording sheets. Therefore, in this case, the absolute value of the applied voltage may be reduced to increase the quantity of the oil.

The voltage applied to the electrode layer of the oil regulating member may be changed in accordance with a combination of the foregoing conditions (1)–(5).

Figure 7:
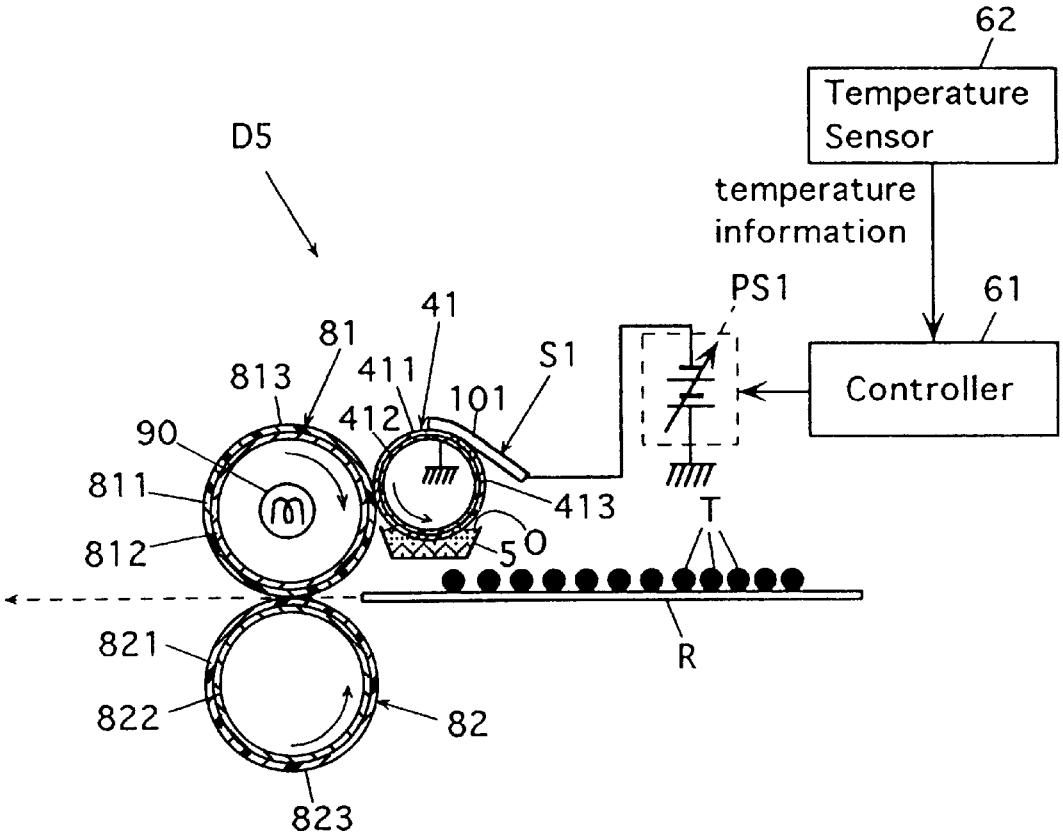
FIG. 7 is a schematic cross section showing further another example of the fixing device according to the invention.

As described above, when the voltage applied to the electrode layer of the oil regulating member is changed in accordance with the conditions, a power source which can supplies a variable voltage may be employed as the power source connected to the electrode layer, and a controller or the like may be employed for controlling the output voltage of the power source in accordance with change in conditions. The controller may be supplied with condition information. A controller of the image forming apparatus usually can have or get the condition information such as the number of the recording sheets passed between the two fixing rotary members, the number of the recording sheets to be passed continuously between the two fixing rotary members, information indicating whether the unfixed toner image is a color toner image or a monochrome toner image, and the toner density, and such information may be supplied from the controller of the image forming apparatus. If necessary, a sensor(s) for detecting condition information such as a temperature is arranged in the fixing device or the image forming apparatus provided with the fixing device. For example, when the applied voltage is to be changed in accordance with the temperature, a temperature sensor may be arranged in the fixing device. An example of this structure is employed in the fixing device D5 shown in FIG. 7.

The fixing device D5 is based on the fixing device D1. The fixing device D5 is provided with a temperature sensor 62 for controlling the oil quantity based on the environmental temperature.

In the fixing device D5, the electrode layer 101 of the oil regulating sheet S1 is connected to the DC power source PS1 of an output voltage variable type. A controller 61 can control the output voltage of the power source PS1. The controller 61 controls the voltage, which is applied to the electrode layer 101 as described above, based on the temperature information sent from the temperature sensor 62.

In the fixing devices D1–D5 described above, the oil regulating sheet is formed of the single layer, i.e., the electrode layer which is in contact with the oil spreading rotary member or the fixing rotary member, however, the structure of the oil regulating sheet is not restricted to this.

Other forms of the oil regulating sheet will now be described below. The following description will be given on structures, in which each oil regulating sheet is arranged in the fixing device D2 shown in FIG. 4 instead of the oil regulating sheet S1, and is in contact with the fixing roller 81.

In figures showing oil regulating sheets S2–S6 which will be described below and the figures showing the oil regulating sheet S1 already described, the same reference numbers or characters are assigned to parts and portions of the substantially same functions and/or operations. The oil regulating sheets S2–S6 are supported and arranged similarly to the oil regulating sheet S1 in the fixing device D2. Support members supporting the oil regulating sheets are not shown in the following figures. The outer peripheral surface 813 of the fixing roller 81 is shown only fragmentarily. The moving direction of the outer peripheral surface 813 is indicated by "$\alpha$". The rotation axis direction of the fixing roller 81 is orthogonal to the direction $\alpha$.

Figure 8:
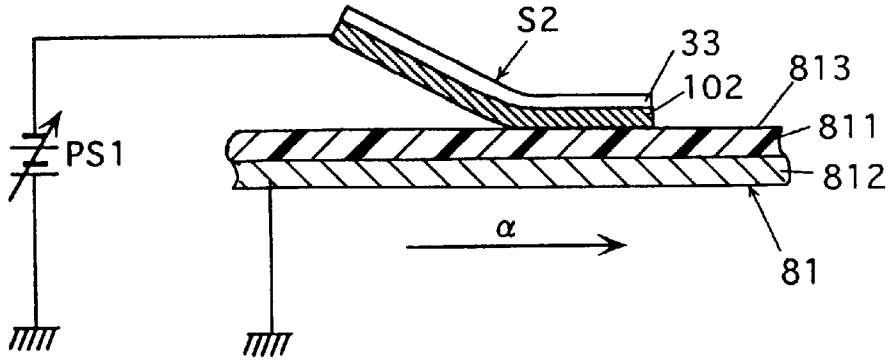
FIG. 8 is a schematic cross section showing another example of an oil regulating sheet provided in the fixing device according to the invention.

For suppressing discharge from the electrode layer to instruments and members arranged near the oil regulating sheet, an insulating layer may be arranged on the surface of the electrode layer remote from the outer peripheral surface of the fixing rotary member. An example of this structure is employed in the oil regulating sheet S2 shown in FIG. 8.

The oil regulating sheet S2 is formed of two layers, i.e., an insulating layer 33 and an electrode layer 102. The electrode layer 102 is arranged on the side near the outer peripheral surface 813, and has a portion in contact with the outer peripheral surface 813. The insulating layer 33 is arranged over the surface of the electrode layer 102 remote from the outer peripheral surface 813. The insulating layer 33 thus arranged can prevent discharge from the electrode layer 102 to instruments and members arranged near the oil regulating sheet S2, and thereby can suppress damages of these instruments and members.

The oil regulating sheet is not restricted to a layer structure formed of one or more layers including the electrode layer which is in contact with the fixing rotary member. As will be described in the following items (III-a) and (III-b), the oil regulating sheet may have a multilayer structure formed of two or more layers including the electrode layer which is not in contact with the outer peripheral surface of the fixing rotary member. The multilayer structures of the oil regulating sheet will now be described. The item (III-a) relates to the oil regulating sheet of the multilayer structure formed of two or more layers including an electrode layer and an insulating layer in contact with the fixing rotary member. The item (III-b) relates to the oil regulating sheet of the multilayer structure formed of three or more layers including an electrode layer (first electrode layer), an insulating layer and a second electrode layer in contact with the outer peripheral surface of the fixing rotary member.

Figure 9:
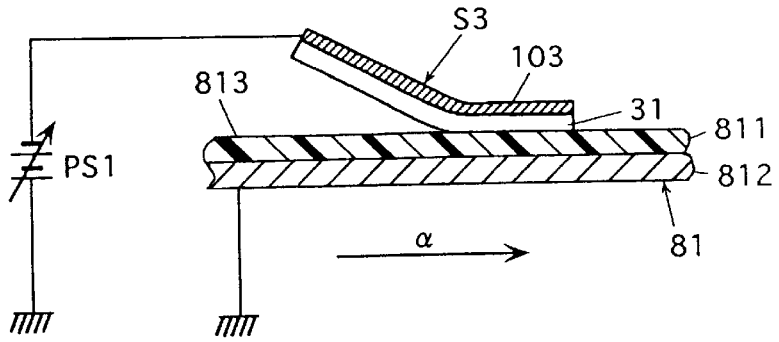
FIG. 9 is a schematic cross section showing still another example of the oil regulating sheet provided in the fixing device according to the invention.

(III-a) FIG. 9 is a schematic cross section of further another example of the oil regulating sheet provided in the fixing device according to the invention.

An oil regulating sheet S3 shown in FIG. 9 is formed of two layers, i.e., an electrode layer 103 and an insulating layer 31. The insulating layer 31 is arranged on the side near the outer peripheral surface 813. The insulating layer 31 is arranged between the electrode layer 103 and the outer peripheral surface 813.

The electrode layer 103 in this example is made of aluminum. The insulating layer 31 in this example is made of polyimide, and has a thickness of 75 $\mu$m. In this example, the electrode layer 103 is prepared by vapor deposition of aluminum over the insulating layer 31.

The electrode layer 103 is connected to the DC power source PS1 which can apply a DC voltage across the electrode layer 103 and the conductive core roller 812 of the fixing roller 81.

The oil regulating sheet S3 can achieve the following advantages compared with the oil regulating sheet S1.

Since the electrode layer 103 supplied with the voltage does not slide on the outer peripheral surface 813, the electrode layer 103 is not damaged so that it can stably produce the electrostatic attraction force for a long term. The insulating layer 31, which slides on the outer peripheral surface 813 with the oil therebetween, is made of a material having a high resistance against wearing and a high sliding property. Therefore, wearing of the insulating layer 31 is suppressed.

As described above, when the oil regulating sheet has a multilayer structure, which includes the electrode layer and the insulating layer in contact with the fixing rotary member, a second insulating layer may be arranged on the surface of the electrode layer remote from the outer peripheral surface of the fixing rotary member for suppressing discharge from the electrode layer to instruments and members arranged near the oil regulating sheet. The surface of the downstream end, in the outer peripheral surface moving direction of the fixing rotary member, of the electrode layer may be coated with an insulator for preventing discharge from the downstream end surface of the electrode layer.

As described above, when the oil regulating sheet has the multilayer structure formed of two or more layers, which include the electrode layer and the insulating layer in contact with the outer peripheral surface of the fixing rotary member, the electrode layer may be divided into two or more in the direction of the rotation axis of the fixing rotary member (i.e., the direction perpendicular to the outer peripheral surface moving direction). An example of this structure is employed in an oil regulating sheet S4 shown in FIG. 10.

In the oil regulating sheet S4, an electrode layer 104 is divided into three in the rotation axis direction of the fixing roller 81 (i.e., in the direction perpendicular to the direction $\alpha$). The electrode layer 104 is formed of three electrode layer portions 104*a*, 104*b* and 104*c*.

The widths of the electrode layer portions 104*a*, 104*b* and 104*c* are determined as follows. In this example, these widths are determined correspondingly to the width, i.e., the length in the rotation axis direction, of the recording sheet moved between the fixing rollers 81 and 82. In this example, the width of the electrode layer portion 104*b* corresponds to the length of the short side of the recording sheet of the A4 size in portrait orientation, which is moved in the direction along its long side. The total width of the three electrode layer portions 104*a*, 104*b* and 104*c* corresponds to the length of the long side of the recording sheet of the A4 size in landscape orientation, which is moved in the direction along its short side.

The electrode layer portions 104*a* and 104*c* are connected to a DC power source PS11. The electrode layer portion 104*b* is connected to a DC power source PS12. A controller CTR1 controls the voltage applied to the electrode layer portions 104*a* and 104*c* from the power source PS11. A controller CTR2 controls the voltage applied to the electrode layer portion 104*b* from the power source PS12.

When fixing the unfixed toner on the A4 sheet in portrait orientation having a short side in the direction perpendicular to the direction $\alpha$, the power source PS12 applies to the electrode layer portion 104*b* the voltage, which can appropriately regulate the quantity of the oil for preventing transfer of the unfixed toner T onto the outer peripheral surface 813, and the power source PS12 applies to the electrode layer portions 104*a* and 104*c* the voltage, which can appropriately regulate the quantity of the oil for minimizing the oil on the portions of the outer peripheral surface 813 opposed to these electrode layer portions. Thereby, the quantity of the oil on the surface portion of the outer peripheral surface 813, which is in contact with the A4 recording sheet in portrait orientation, can be regulated to such an appropriate quantity of oil with which the transfer of the unfixed toner can be prevented. Further, it is possible to minimize the quantity of the oil on the surface portion of the outer peripheral surface 813 which is not in contact with the unfixed toner. Owing to the above, the consumption of oil can be suppressed, and the fixing device can be used for a long term.

When fixing the unfixed toner on the A4 sheet in landscape orientation having a long side in the direction perpendicular to the direction $\alpha$, all the electrode layer portions 104*a*, 104*b* and 104*c* are supplied with the voltage determining appropriately the quantity of the oil, which is enough to prevent transfer of the unfixed toner T onto the outer peripheral surface 813.

Insulators may be interposed between the electrode layer portions 104*a* and 104*b*, and between the electrode layer portions 104*b* and 104*c* for preventing electrical leak therebetween.

The size and transporting direction of the recording sheet as well as the size and the number of the divided electrode layer portions corresponding to the recording sheet are not restricted to the above.

Figure 11:
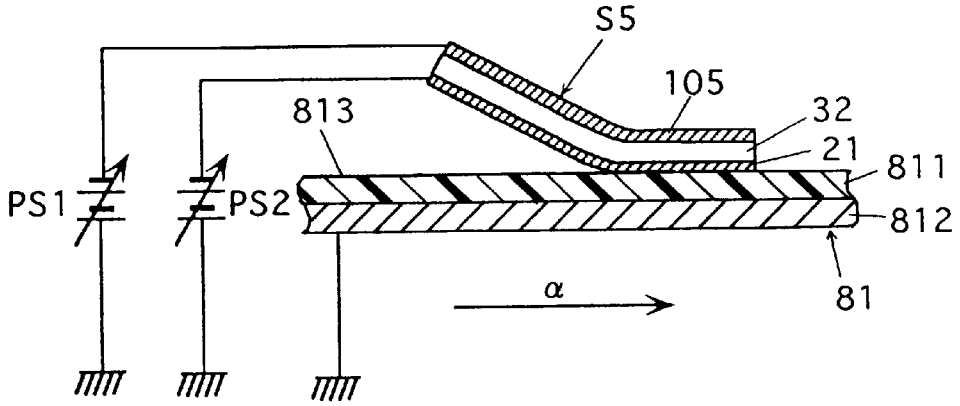
FIG. 11 is a schematic cross section showing further another example of the oil regulating sheet provided in the fixing device according to the invention.

(III-b) FIG. 11 is a schematic cross section of further another example of the oil regulating sheet provided in the fixing device according to the invention.

An oil regulating sheet S5 shown in FIG. 11 is formed of three layers, i.e., a first electrode layer 105, an insulating layer 32 and a second electrode layer 21 layered in this order. The second electrode layer 21 is arranged on the side near the outer peripheral surface 813.

The insulating layer 32 is arranged between the first and second electrode layers 105 and 21 for electrically insulation between them.

The first and second electrode layers 105 and 21 in this example are made of aluminum. The insulating layer 32 in this example is made of polyimide. The insulating layer 32 in this example has a thickness of 75 $\mu$m. In this example, the first and second electrode layers 105 and 21 was formed by vapor deposition of aluminum onto the opposite side surfaces of the insulating layer 32, respectively.

The first electrode layer 105 is connected to the DC power source PS1 which can apply a DC voltage across the first electrode layer 105 and the electrically conductive core roller 812 of the fixing roller 81. The second electrode layer 21 is connected to the DC power source PS2 which can apply a DC voltage across the second electrode layer 21 and the core roller 812.

The oil regulating sheet S5 has the following advantages compared with the oil regulating sheet S3 and others.

In the oil regulating sheet S5, the second electrode layer 21 forms a surface layer opposed to and in contact with the outer peripheral surface 813, and therefore can provide a larger electrostatic attraction force than the oil regulating sheet S3. Since the two, i.e., first and second electrode layers 105 and 21 can produce the electrostatic attraction force, the electrostatic attraction force can be larger than that produced by the single electrode layer. Owing to the above, the oil having a high viscosity such as high-viscosity silicon oil can be used. The high-viscosity silicon oil causes less swelling of the silicon rubber forming the surface layer of the fixing roller 82. Therefore, variation in diameter of the fixing roller 82 can be suppressed. Since the high-viscosity silicon oil has a high resistance against thermal deterioration, and therefore can be used for a long term.

As described above, when the oil regulating sheet has the multilayer structure, which includes the first electrode layer, the insulating layer and the second electrode layer in contact with the outer peripheral surface of the fixing rotary member, a second insulating layer may be arranged over the surface of the first electrode layer remote from the outer peripheral surface of the fixing rotary member for suppressing discharge from the first electrode layer to instruments and members arranged near the oil regulating sheet.

As described above, when the oil regulating sheet has the multilayer structure formed of three or more layers, which include the first electrode layer, the insulating layer and the second electrode layer in contact with the outer peripheral surface of the fixing rotary member, and further when the voltages of the same polarity are applied to the first and second electrode layers, respectively, the common power source may be connected to the first and second electrode layers. This structure is employed in the oil regulating sheet shown in FIG. 12.

Figure 12:
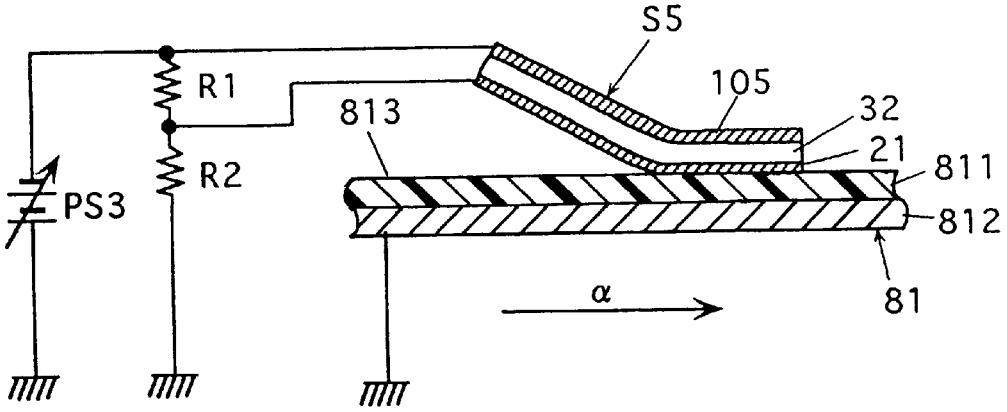
FIG. 12 is a schematic cross section showing further different example of the oil regulating sheet provided in the fixing device according to the invention.

The oil regulating sheet S5 shown in FIG. 12 is connected to a single power source PS3 for applying the voltages to the first and second electrode layers 105 and 21. The voltage supplied from the power source PS3 is divided by resistors R1 and R2, and is applied to the first and second electrode layers 105 and 21. Compared with the structure employing two power sources, the power source can be smaller in number by one so that the whole fixing device can be compact and inexpensive.

Figure 13:
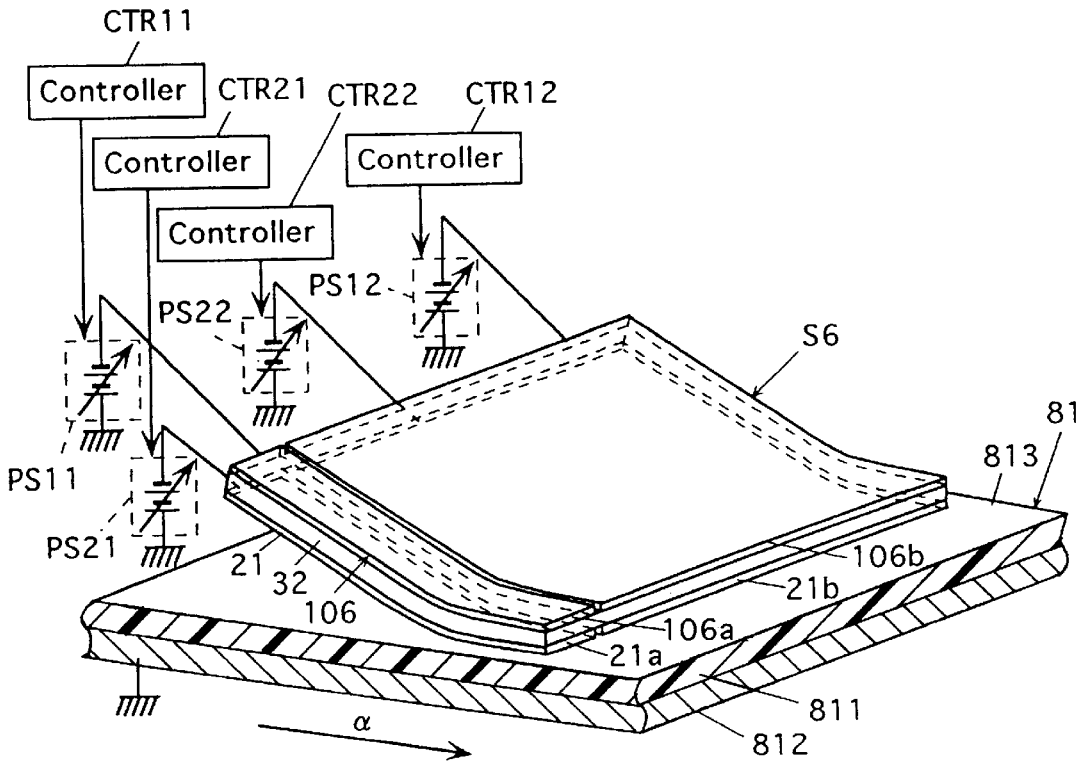
FIG. 13 is a schematic perspective view showing further different example of the oil regulating sheet provided in the fixing device according to the invention.

As described above, when the oil regulating sheet has the multilayer structure formed of three or more layers, which include the first electrode layer, the insulating layer and the second electrode layer in contact with the outer peripheral surface of the fixing rotary member, the first electrode layer may be divided into two or more in the rotation axis direction of the fixing rotary member, as can be done in the multilayer structure formed of two or more layers, which include the electrode layer and the insulating layer in contact with the outer peripheral surface of the fixing rotary member. The second electrode layer may also be divided into two or more. An example of the above structure is employed in an oil regulating sheet S6 shown in FIG. 13.

In the oil regulating sheet S6, an electrode layer 106 is divided into two in the rotation axis direction of the fixing roller 81 (i.e., in the direction perpendicular to the direction $\alpha$). The first electrode layer 106 is formed of two electrode layer portions 106*a* and 106*b*.

The widths (i.e., lengths in the rotation axis direction) of the electrode layer portions 106*a* and 106*b* of the first electrode layer 106 are determined correspondingly to the width, i.e., the length in the rotation axis direction, of the recording sheet moved between the fixing rollers 81 and 82. In this example, the width of the electrode layer portion 106*b* corresponds to the length of the short side of the recording sheet of the A4 size, and the total width of the two electrode layer portions 106*a* and 106*b* corresponds to the length of the long side of the recording sheet of the A4 size.

The second electrode layer 21 is likewise divided into two in the rotation axis direction of the fixing roller 81 (i.e., in the direction perpendicular to the direction $\alpha$). The second electrode layer 21 is formed of two electrode layer portions 21*a* and 21*b*.

The widths (i.e., lengths in the rotation axis direction) of the electrode layer portions 21*a* and 21*b* of the second electrode layer 21 are determined correspondingly to the width, i.e., the length in the rotation axis direction, of the recording sheet moved between the fixing rollers 81 and 82. The width of the electrode layer portion 21*b* corresponds to the length of the short side of the recording sheet of the A4 size, and the total width of the two electrode layer portions 21*a* and 21*b* corresponds to the length of the long side of the recording sheet of the A4 size.

The first electrode layer portions 106*a* and 106*b* are connected to the DC power sources PS11 and PS12, respectively. The second electrode layer portions 21*a* and 21*b* are connected to the DC power sources PS21 and PS22, respectively. Controllers CTR11, CTR12, CTR21 and CTR22 control the voltages applied to the electrode layer portions 106*a*, 106*b*, 21*a* and 21*b* from the power sources PS11, PS12, PS21 and PS22, respectively.

Figure 10:
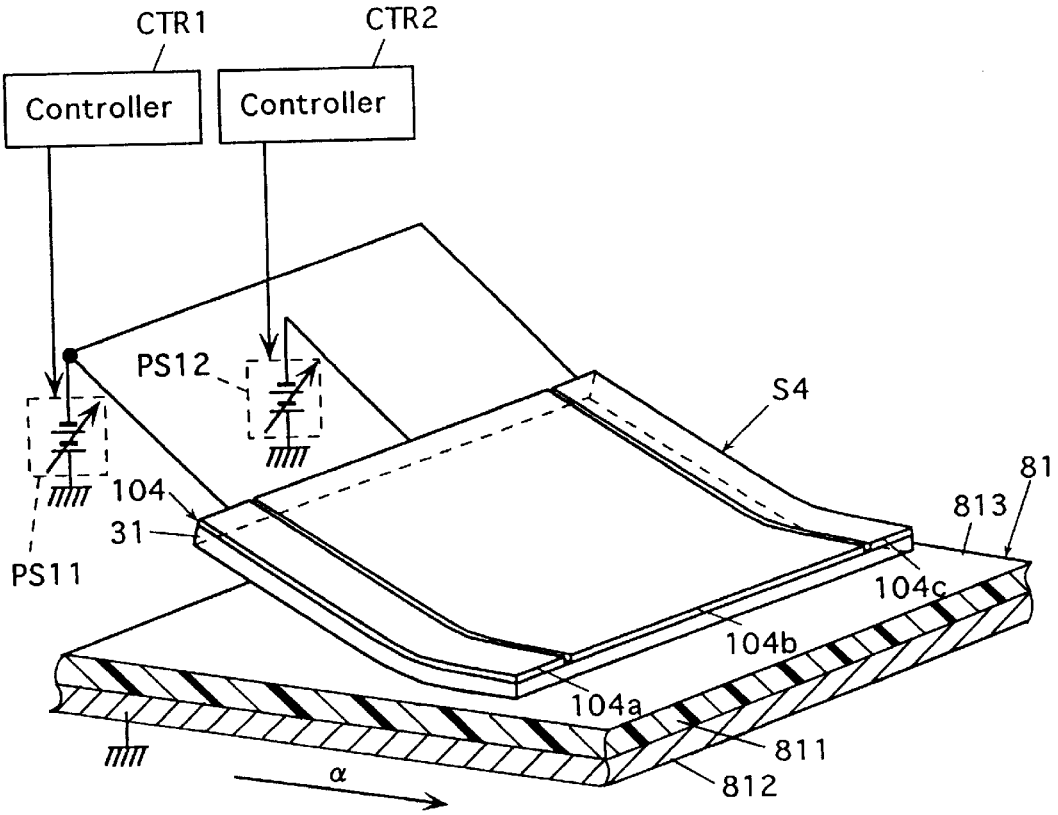
FIG. 10 is a schematic perspective view showing yet another example of an oil regulating sheet provided in the fixing device according to the invention.

Similarly to the oil regulating sheet S4 shown in FIG. 10, the oil regulating sheet S6 can provide the appropriate amount of oil, which is required for suppressing transfer of the unfixed toner, to the portion of the outer peripheral surface 813 in contact with the record sheet, and can minimize the quantity of the oil for the portion of the outer peripheral surface 813 which is not in contact with the recording sheet and thus does not require the oil.

The size and transporting direction of the recording sheet as well as the size and the number of the divided electrode layer portions corresponding to the recording sheet are not restricted to the above.

The oil regulating sheets S2–S6 described above can be used for control of the quantity of the oil on the oil spreading roller.

Figure 14:
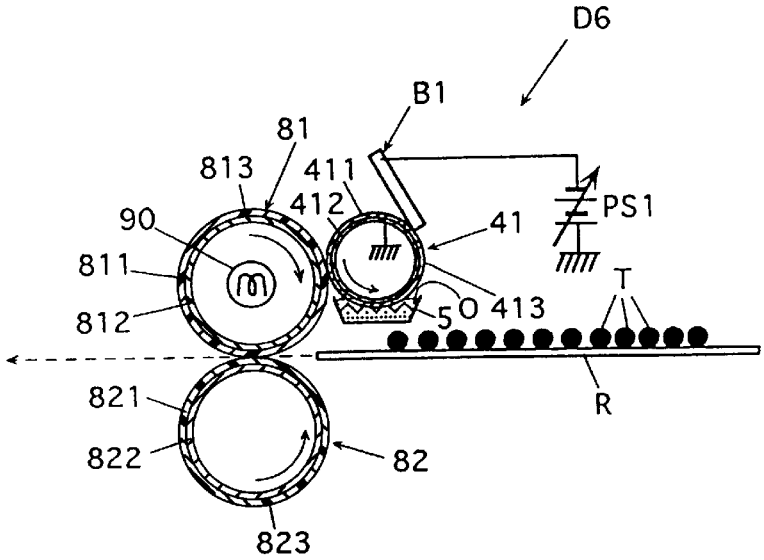
FIG. 14 is a schematic cross section showing further different example of the fixing device according to the invention.

(III-3) FIG. 14 is a schematic cross section showing further another example of the fixing device according to the invention.

A fixing device D6 shown in FIG. 14 is substantially similar to the fixing device D1 shown in FIG. 1 except that an oil regulating blade B1 is employed instead of the oil regulating sheet S1.

In the fixing device D6 shown in FIG. 14, the regulating blade B1 is in contact with the outer peripheral surface 413 of the oil spreading roller 41.

The regulating blade B1 has an upstream edge portion, in the peripheral surface moving direction of the oil spreading roller 41, which is in contact with the oil spreading roller 41. The regulating blade B1 has a downstream end which is supported by supporting means (not shown). The regulating blade B1 is swingably supported.

The regulating blade B1 in this example is made of an electrically resistant material.

The regulating blade B1 is connected to the variable DC power source PS1. The power source PS1 can apply a DC voltage across the regulating blade B1 and the core roller 412 of the oil spreading roller 41.

In the fixing device D6, similar to the fixing device D1, the force of electrostatically attracting the regulating blade B1 toward the oil spreading roller 41 can be controlled by the voltage applied to the regulating blade B1. Thereby, the quantity of the oil transported downstream from the regulating blade B1 can be controlled, and the quantity of the oil, which is spread over the fixing roller 81 by the oil spreading roller 41, can be controlled. In contrast to the prior art, a complicated mechanical mechanism is not required for controlling the pressing force of the regulating blade B1 against the oil spreading roller 41 so that the fixing device D6 can have a compact and inexpensive structure.

Figure 15:
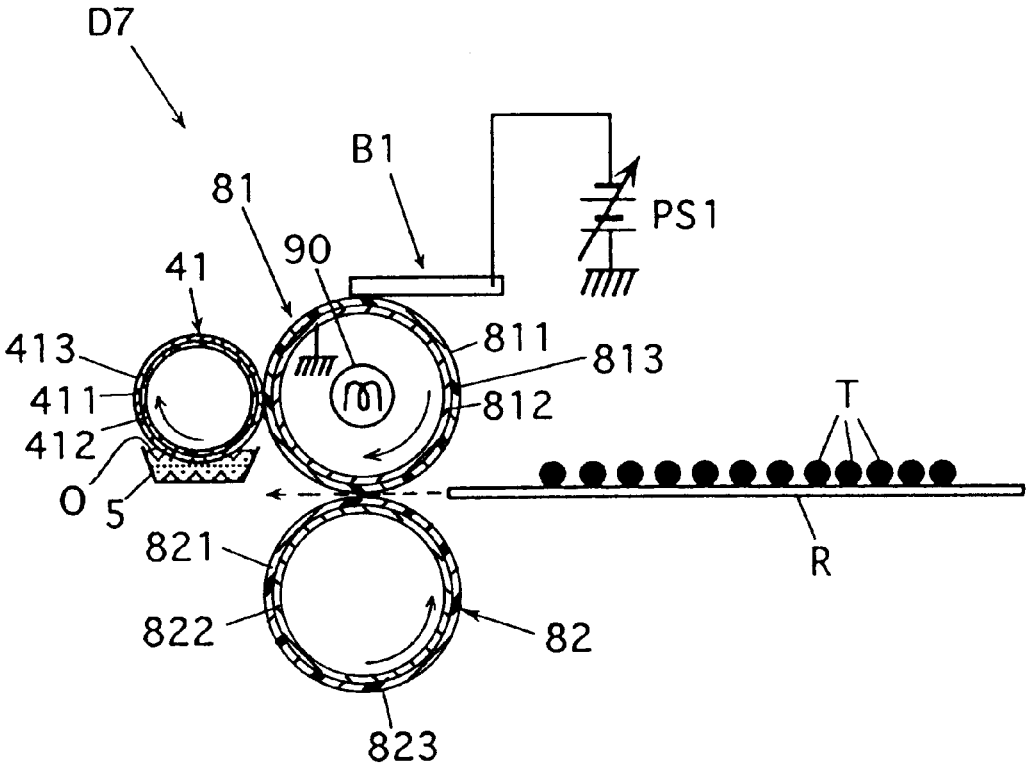
FIG. 15 is a schematic cross section showing further different example of the fixing device according to the invention.

(III-4) FIG. 15 is a schematic cross section showing further another example of the fixing device according to the invention.

Figure 4:
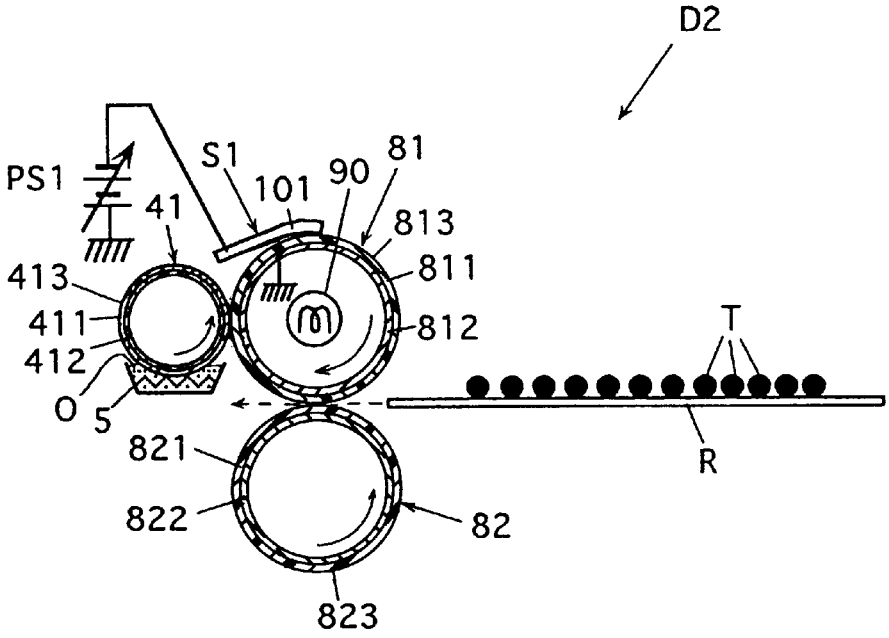
FIG. 4 is a schematic cross section showing another example of the fixing device according to the invention.

A fixing device D7 shown in FIG. 15 is substantially similar to the fixing device D2 shown in FIG. 4 except that the oil regulating blade B1 is employed instead of the oil regulating sheet S1.

In the fixing device D7, the regulating blade B1 is in contact with the outer peripheral surface 813 of the fixing roller 81.

The regulating blade B1 has an upstream end portion, in the peripheral surface moving direction of the fixing roller 81, which is in contact with the fixing roller 81. The regulating blade B1 has a downstream end portion which is supported by supporting means (not shown). The regulating blade B1 is swingably supported.

The regulating blade B1 in this example is made of an electrically resistant material.

The regulating blade B1 is connected to the variable DC power source PS1. The power source PS1 can apply a DC voltage across the regulating blade B1 and the core roller 812 of the fixing roller 81.

In the fixing device D7, the force of electrostatically attracting the regulating blade B1 to the fixing roller 81 can be controlled by the voltage applied to the regulating blade B1. Thereby, the quantity of the oil transported downstream from the regulating blade B1 can be controlled, and the quantity of the oil, which is present on the fixing roller 81 when the oil comes into contact with the recording sheet R carrying the unfixed toner, can be controlled appropriately. In contrast to the prior art, a complicated mechanical mechanism is not required for controlling the pressing force of the regulating blade B1 against the fixing roller 81 so that the fixing device D7 can have a compact and inexpensive structure.

The blades used as the regulating members, e.g., in the fixing devices D6 and D7 can have structures similar to those of the oil regulating sheets already described. For example, the regulating blade may have a structure in which the electrode layer and the insulating layer are layered in this order, and a part of the insulating layer may be brought into contact with the target surface (e.g., the outer peripheral surface 413 of the oil spreading roller 41 in the fixing device D6). The regulating blade may have a structure, in which the first electrode layer, the insulating layer and the second electrode layer are layered in this order, and the second electrode layer has a portion in contact with the target surface. In the fixing devices D6 and D7, the regulating blade has the upstream portion, in the moving direction of the target surface, which is in contact with the target surface. Alternatively, the downstream portion of the regulating blade may be in contact with the target surface.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A liquid spreading device for spreading liquid over a target surface to be moved relatively to the liquid spreading device in a predetermined direction, comprising:

a regulating member which is brought into contact with the target surface through the liquid; and a voltage applying unit for applying an electrical bias voltage across said regulating member and the target surface for moving said regulating member.

2. The liquid spreading device according to claim 1, wherein said regulating member is a blade.

3. The liquid spreading device according to claim 2, wherein said blade has an end portion which is brought into contact with the target surface through the liquid.

4. The liquid spreading device according to claim 3, wherein said end portion is to be located at an upstream side of said blade in the predetermined direction.

5. The liquid spreading device according to claim 1, wherein said regulating member is a sheet.

6. The liquid spreading device according to claim 5, wherein said sheet has a first end portion and a second end portion;

said first end portion and said second end portion are to be located at an upstream side and a downstream side of said sheet in the predetermined direction, respectively;

said first end portion is to be opposed to the target surface; and said second end portion is brought into contact with the target surface through the liquid.

7. The liquid spreading device according to claim 5, wherein said sheet is two-dimensionally brought into contact with the target surface through the liquid.

8. The liquid spreading device according to claim 1, wherein said voltage applying unit applies a DC voltage as the electrical bias voltage.

9. The liquid spreading device according to claim 1, wherein said voltage applying unit includes an electrical variable voltage source.

10. The liquid spreading device according to claim 1, wherein said voltage applying unit includes an electrical source and an electrical variable resistor.

11. The liquid spreading device according to claim 1, wherein said regulating member includes a first electrode layer to which said voltage applying unit is connected.

12. The liquid spreading device according to claim 11, wherein a part of said first electrode layer is brought into contact with the target surface through the liquid.

13. The liquid spreading device according to claim 11, wherein said regulating member further includes an electrical insulating layer to be located between said first electrode layer and the target surface.

14. The liquid spreading device according to claim 13, wherein a part of said electrical insulating layer is brought into contact with the target surface through the liquid.

15. The liquid spreading device according to claim 13, wherein said regulating member further includes a second electrode layer to be located between said electrical insulating layer and the target surface; and said second electrode layer is brought into contact with the target surface through the liquid.

16. The liquid spreading device according to claim 15, wherein said second electrode layer is divided into a plurality of portions in a direction orthogonal to the predetermined direction.

17. The liquid spreading device according to claim 16, wherein said voltage applying unit includes a plurality of control sections corresponding to said portions of said second electrode layer, respectively.

18. The liquid spreading device according to claim 11, wherein said first electrode layer is divided into a plurality of portions in a direction orthogonal to the predetermined direction.

19. The liquid spreading device according to claim 18, wherein said voltage applying unit includes a plurality of control sections corresponding to said portions of said first electrode layer, respectively.

20. The liquid spreading device according to claim 1, further comprising:

a spreading roller for roughly spreading the liquid over the target surface, wherein said spreading roller is located at an upstream side of said regulating member in the predetermined direction.

21. The liquid spreading device according to claim 20, further comprising:

a sump for accommodating the liquid, wherein said spreading roller is to be partially dipped into the liquid in the sump.

22. The liquid spreading device according to claim 1, further comprising:

a sump for accommodating the liquid, wherein the target surface is to be dipped into the liquid in the sump at a position upstream to said regulating member in the predetermined direction.

23. A fixing device for fixing a toner image onto an image bearing surface of a recording sheet, comprising:

a rotating member having an outer surface to be in contact with the image bearing surface;

a regulating member which is brought into contact with the outer surface of said rotating member through liquid; and a voltage applying unit for applying an electrical bias voltage across said regulating member and the outer surface of said rotating member.

24. The fixing device according to claim 23, wherein said regulating member is a blade.

25. The fixing device according to claim 24, wherein said blade has an end portion which is brought into contact with the outer surface of said rotating member through the liquid.

26. The fixing device according to claim 25, wherein said rotating member is to be rotated to move the outer surface in a predetermined direction with respect to said regulating member; and said end portion is to be located at an upstream side of said blade in the predetermined direction.

27. The fixing device according to claim 23, wherein said regulating member is a regulating sheet.

28. The fixing device according to claim 27, wherein said rotating member is to be rotated to move the outer surface in a predetermined direction with respect to said regulating sheet;

said regulating sheet has a first end portion and a second end portion;

said first end portion and said second end portion are to be located at an upstream side and a downstream side of said regulating sheet in the predetermined direction, respectively;

said first end portion is to be opposed to the outer surface of said rotating member; and said second end portion is brought into contact with the outer surface of said rotating member through the liquid.

29. The fixing device according to claim 27, wherein said regulating sheet is two-dimensionally brought into contact with the outer surface of said rotating member through the liquid.

30. The fixing device according to claim 23, wherein said voltage applying unit applies a DC voltage as the electrical bias voltage.

31. The fixing device according to claim 23, wherein said voltage applying unit includes an electrical variable voltage source.

32. The fixing device according to claim 23, wherein said voltage applying unit includes an electrical source and an electrical variable resistor.

33. The fixing device according to claim 23, wherein said regulating member includes a first electrode layer to which said voltage applying unit is connected.

34. The fixing device according to claim 33, wherein a part of said first electrode layer is brought into contact with the outer surface of said rotating member through the liquid.

35. The fixing device according to claim 33, wherein said regulating member further includes an electrical insulating layer to be located between said first electrode layer and the outer surface of said rotating member.

36. The fixing device according to claim 35, wherein a part of said electrical insulating layer is brought into contact with the outer surface of said rotating member through the liquid.

37. The fixing device according to claim 35, wherein said regulating member further includes a second electrode layer to be located between said electrical insulating layer and the outer surface of said rotating member; and said second electrode layer is brought into contact with the outer surface of said rotating member through the liquid.

38. The fixing device according to claim 37, wherein said rotating member is to be rotated to move the outer surface in a predetermined direction with respect to said regulating member; and said second electrode layer is divided into a plurality of portions in a direction orthogonal to the predetermined direction.

39. The fixing device according to claim 38, wherein said voltage applying unit includes a plurality of control sections corresponding to said portions of said second electrode layer, respectively.

40. The fixing device according to claim 33, wherein said rotating member is to be rotated to move the outer surface in a predetermined direction with respect to said regulating member; and said first electrode layer is divided into a plurality of portions in a direction orthogonal to the predetermined direction.

41. The fixing device according to claim 40, wherein said voltage applying unit includes a plurality of control sections corresponding to said portions of said first electrode layer, respectively.

42. The fixing device according to claim 23, further comprising:

a spreading roller for roughly spreading the liquid over the outer surface of said rotating member, wherein said rotating member is to be rotated to move the outer surface in a predetermined direction with respect to said regulating member; and said spreading roller is located at an upstream side of said regulating member in the predetermined direction.

43. The fixing device according to claim 42, further comprising:

a sump for accommodating the liquid, wherein said spreading roller is to be partially dipped into the liquid in the sump.

44. The fixing device according to claim 42, wherein the outer surface of said spreading roller is impregnated with the liquid.

45. The fixing device according to claim 23, further comprising:

a sump for accommodating the liquid, wherein said rotating member is to be rotated to move the outer surface in a predetermined direction with respect to said regulating member; and a part of said rotating member is to be dipped into the liquid in the sump at a position upstream to said regulating member in the predetermined direction.

46. The fixing device according to claim 23, wherein said liquid is oil for increasing releasability of the toner image from the outer surface of said rotating member.

47. A fixing device for fixing a toner image onto an image bearing surface of a recording sheet, comprising:

a rotating member having an outer surface to be in contact with the image bearing surface;

a spreading roller which is provided for spreading liquid over the outer surface of said rotating member and has an outer surface in contact with the outer surface of said rotating member;

a regulating member which is brought into contact with the outer surface of said spreading roller through the liquid; and a voltage applying unit for applying an electrical bias voltage across said regulating member and the outer surface of said spreading roller.

48. The fixing device according to claim 47, wherein said regulating member is a blade.

49. The fixing device according to claim 48, wherein said blade has an end portion which is brought into contact with the outer surface of said spreading roller through the liquid.

50. The fixing device according to claim 49, wherein said spreading roller is to be rotated to move the outer surface in a predetermined direction with respect to said regulating member; and said end portion is to be located at an upstream side of said blade in the predetermined direction.

51. The fixing device according to claim 47, wherein said regulating member is a regulating sheet.

52. The fixing device according to claim 51, wherein said spreading roller is to be rotated to move the outer surface in a predetermined direction with respect to said regulating sheet;

said regulating sheet has a first end portion and a second end portion;

said first end portion and said second end portion are to be located at an upstream side and a downstream side of said regulating sheet in the predetermined direction, respectively;

said first end portion is to be opposed to the outer surface of said spreading roller; and said second end portion is brought into contact with the outer surface of said spreading roller through the liquid.

53. The fixing device according to claim 51, wherein said regulating sheet is two-dimensionally brought into contact with the outer surface of said spreading roller through the liquid.

54. The fixing device according to claim 47, wherein said voltage applying unit applies a DC voltage as the electrical bias voltage.

55. The fixing device according to claim 47, wherein said voltage applying unit includes an electrical variable voltage source.

56. The fixing device according to claim 47, wherein said voltage applying unit includes an electrical source and an electrical variable resistor.

57. The fixing device according to claim 47, wherein said regulating member includes a first electrode layer to which said voltage applying unit is connected.

58. The fixing device according to claim 57, wherein a part of said first electrode layer is brought into contact with the outer surface of said spreading roller through the liquid.

59. The fixing device according to claim 57, wherein said regulating member further includes an electrical insulating layer to be located between said first electrode layer and the outer surface of said spreading roller.

60. The fixing device according to claim 59, wherein a part of said electrical insulating layer is brought into contact with the outer surface of said spreading roller through the liquid.

61. The fixing device according to claim 59, wherein said regulating member further includes a second electrode layer to be located between said electrical insulating layer and the outer surface of said spreading roller; and said second electrode layer is brought into contact with the outer surface of said spreading roller through the liquid.

62. The fixing device according to claim 61, wherein said spreading roller is to be rotated to move the outer surface in a predetermined direction with respect to said regulating member; and said second electrode layer is divided into a plurality of portions in a direction orthogonal to the predetermined direction.

63. The fixing device according to claim 62, wherein said voltage applying unit includes a plurality of control sections corresponding to said portions of said second electrode layer, respectively.

64. The fixing device according to claim 57, wherein said spreading roller is to be rotated to move the outer surface in a predetermined direction with respect to said regulating member; and said first electrode layer is divided into a plurality of portions in a direction orthogonal to the predetermined direction.

65. The fixing device according to claim 64, wherein said voltage applying unit includes a plurality of control sections corresponding to said portions of said first electrode layer, respectively.

66. The fixing device according to claim 47, further comprising:

a sump for accommodating the liquid, wherein said spreading roller is to be partially dipped into the liquid in the sump.

67. The fixing device according to claim 47, wherein said liquid is oil for increasing releasability of the toner image from the outer surface of said rotating member.

* * * * *